US009620259B2

(12) United States Patent
Pozzo et al.

(10) Patent No.: US 9,620,259 B2
(45) Date of Patent: Apr. 11, 2017

(54) COMPOSITES INCORPORATED A CONDUCTIVE POLYMER NANOFIBER NETWORK

(71) Applicant: University of Washington through its Centre for Commercialization, Seattle, WA (US)

(72) Inventors: Lilo Danielle Pozzo, Seattle, WA (US); Gregory Newbloom, Seattle, WA (US)

(73) Assignee: University of Washington through its Center for Commercialization, Seattle, WA (US)

( * ) Notice: Subject to any disclaimer, the term of this patent is extended or adjusted under 35 U.S.C. 154(b) by 159 days.

(21) Appl. No.: 14/389,708

(22) PCT Filed: Apr. 1, 2013

(86) PCT No.: PCT/US2013/034835
§ 371 (c)(1),
(2) Date: Sep. 30, 2014

(87) PCT Pub. No.: WO2013/149251
PCT Pub. Date: Oct. 3, 2013

(65) Prior Publication Data

US 2015/0144844 A1 May 28, 2015

Related U.S. Application Data

(60) Provisional application No. 61/618,126, filed on Mar. 30, 2012.

(51) Int. Cl.
*H01B 1/00* (2006.01)
*H01B 1/12* (2006.01)
(Continued)

(52) U.S. Cl.
CPC ..... *H01B 1/127* (2013.01); *D01F 6/74* (2013.01); *D01F 6/76* (2013.01); *H01B 1/124* (2013.01)

(58) Field of Classification Search
CPC ..... H01B 1/00; H01B 1/121–1/128
See application file for complete search history.

(56) References Cited

U.S. PATENT DOCUMENTS 5,219,492 A 6/1993 Osterholm et al.
5,662,833 A 9/1997 Laakso et al.
(Continued)

FOREIGN PATENT DOCUMENTS

EP 2 540 491 A2 1/2013
WO 87/00677 A1 1/1987
(Continued)

OTHER PUBLICATIONS

Nam et al "Doping effect of organosulfonic acid in poly(3-hexylthiophene) films . . . ", ACS Applied Materials & Interfaces 2012, 4, 1281-1288.*
(Continued)

*Primary Examiner* — Mark Kopec
(74) *Attorney, Agent, or Firm* — Christensen O'Connor Johnson Kindness PLLC

(57) ABSTRACT

Methods of forming composites that incorporate networks of conductive polymer nanofibers are provided. Networks of less-than conductive polymers are first formed and then doped with a chemical dopant to provide networks of conductive polymers. The networks of conductive polymers are then incorporated into a matrix in order to improve the conductivity of the matrix. The formed composites are useful as conductive coatings for applications including electromagnetic energy management on exterior surfaces of vehicles.

17 Claims, 10 Drawing Sheets

(51) Int. Cl.
*D01F 6/74* (2006.01)
*D01F 6/76* (2006.01)

(56) References Cited

U.S. PATENT DOCUMENTS

| | | | | |
|---|---|---|---|---|
| 6,150,032 | A | 11/2000 | Yang et al. | |
| 8,263,503 | B2 | 9/2012 | Cawse | |
| 2004/0022718 | A1 | 2/2004 | Stupp | |
| 2005/0131139 | A1 | 6/2005 | Kanen | |
| 2005/0272855 | A1 | 12/2005 | Renken | |
| 2009/0275689 | A1 | 11/2009 | Isayev | |
| 2011/0014356 | A1 | 1/2011 | Fornes | |
| 2011/0162788 | A1 | 7/2011 | Mizrahi | |
| 2011/0229759 | A1* | 9/2011 | Yazami ..... | H01M 4/0402 429/213 |
| 2011/0248401 | A1 | 10/2011 | Hellstrom | |

FOREIGN PATENT DOCUMENTS

| | | | |
|---|---|---|---|
| WO | 89/01015 | A1 | 2/1989 |
| WO | 90/09027 | A1 | 8/1990 |

OTHER PUBLICATIONS

Newbloom et al "Electrical, mechanical, and structural characterization of self-assembly in poly(3-hexylthiophene organogel networks", ACS Macromolecules 2012, 45, 3452-62.*
Wang et al "Charge transport of hydrochloric acid doped polyaniline . . . ", Macromolecules 1994, 27, 5871-76.*
Abo El Maaty, M.I., et al., "A Unified Context for Spherulitic Growth in Polymers," Macromolecules 31(1)153-157, Jan. 1998.
Abramoff, M.D., et al., "Image Processing With ImageJ," Biophotonics International 11(7):36-42, Jul. 2004.
Alcazar, D., et al., "Gel Processing for Highly Oriented Conjugated Polymer Films," Macromolecules 41(24):9863-9868, Dec. 2008.
Arif, M., et al., "Poly(3-hexylthiophene) Crystalline Nanoribbon Network for Organic Field Effect Transistors," Applied Physics Letters 96(24):243304-243307, Jun. 2010.
Avrami, M., "Granulation, Phase Change, and Microstructure Kinetics of Phase Change. III," Journal of Chemical Physics 9(2):177-184, Feb. 1941.
Avrami, M., "Kinetics of Phase Change. I: General Theory," Journal of Chemical Physics 7(12):1103-1112, Dec. 1939.
Bao, Z., et al., "Soluble and Processable Regioregular Poly(3-hexylthiophene) for Thin Film Field-Effect Transistor Applications With High Mobility," Applied Physics Letters 69(26):4108-4110, Dec. 1996.
Barth, S., et al., "Extrinsic and Intrinsic DC Photoconductivity in a Conjugated Polymer," Physical Review B: Condensed Matter and Material Physics 56(7):3844-3851, Aug. 1997.
Benoit, H., "La Diffusion de la Lumiére par des Macromolecules en Chaînes en Solution dans un Bon Solvent," Comptes Rendus Hebdomadaires des Séances de l'Académie des Sciences 245(25):2244-2247, Dec. 1957.
Bundgaard, E., and F.C. Krebs, "Low Band Gap Polymers for Organic Photovoltaics," Solar Energy Materials and Solar Cells 91(11):954-985, Jul. 2007.
Butler, P., "DANSE/SANS: SansView," Version 2.1.1, May 2012, <https://web.archive.org/web/20120902070907/http://danse.chem.utk.edu/sansview.html> [retrieved Nov. 9, 2016], 3 pages.
Chang, J.F., et al., "Enhanced Mobility of Poly(3-hexylthiophene) Transistors by Spin-Coating From High-Boiling-Point Solvents," Chemistry of Materials 16(23):4772-4776, Nov. 2004.
Chen, C.-Y., et al., "Formation and Thermally-Induced Disruption of Nanowhiskers in Poly(3-hexylthiophene)/Xylene Gel Studied by Small-Angle X-Ray Scattering," Macromolecules 43(17):7305-7311, Sep. 2010.
Chen, D., et al., "P3HT/PCBM Bulk Heterojunction Organic Photovoltaics: Correlating Efficiency and Morphology," Nano Letters 11(2):561-567, Feb. 2011.
Chen, J.-H., et al., "Gelation and Its Effect on the Photophysical Behavior of Poly(9,9-dioctylfluorene-2,7-diyl) in Toluene," Macromolecules 42(4):1306-1314, Feb. 2009.
Clark, J., et al., "Determining Exciton Bandwidth and Film Microstructure in Polythiophene Films Using Linear Absorption Spectroscopy," Applied Physics Letters 94(16):163306-1-163306-3, Apr. 2009.
Coakley, K.M., and M.D. McGehee, "Conjugated Polymer Photovoltaic Cells," Chemistry of Materials 16(23):4533-4542, Nov. 2004.
Coffey, D.C., et al., "Mapping Local Photocurrents in Polymer/Fullerene Solar Cells With Photoconductive Atomic Force Microscopy," Nano Letters 7(3):738-744, Mar. 2007.
Cravino, A., and N.S. Sariciftci, "Double-Cable Polymers for Fullerene Based Organic Optoelectronic Applications," Journal of Materials Chemistry 12(7):1931-1943, May 2002.
Department of Energy, "Basic Research Needs for Solar Energy Utilization: Report of the Basic Energy Sciences Workshop on Solar Energy Utilization, Apr. 18-21, 2005," [online] <http://science.energy.gov/~/media/bes/pdf/reports/files/Basic_Research_Needs_for_Solar_Energy_Utilization_rpt.pdf>, revised Sep. 2005, 276 pages.
Erwin, M.M., et al. "Effects of Impurities on the Optical Properties of Poly-3-Hexylthiophene Thin Films," Thin Solid Films 409(2):198-205, Apr. 2002.
Glinka, C.J., et al., "The 30 m Small-Angle Neutron Scattering Instruments at the National Institute of Standards and Technology," Journal of Applied Crystallography 31(Pt. 3):430-445, Jun. 1998.
Guo, X., et al., "Phthalimide-Based Polymers for High Performance Organic Thin-Film Transistors," Journal of the American Chemical Society 131(21):7206-7207, Jun. 2009.
Halls, J.J.M., et al., "Efficient Photodiodes From Interpenetrating Polymer Networks," Nature 376(6540):498-500, Aug. 1995.
Hammouda, B., "SANS From Homogeneous Polymer Mixtures: A Unified Overview," Advances in Polymer Science 106:87-133, 1993.
Hecht, A.-M., et al., "Structural Inhomogeneities in the Range 2.5-2500 Å in Polyacrylamide Gels," Macromolecules 18(11):2167-2173, Nov. 1985.
Hoppe, H., and N.S. Sariciftci, "Morphology of Polymer/Fullerene Bulk Heterojunction Solar Cells," Journal of Materials Chemistry 16(1):45-61, 2006.
Hoppe, H., and N.S. Sariciftci, "Organic Solar Cells: An Overview," Journal of Materials Research 19(7):1924-1945, Jul. 2004.
Huang, P.-T., et al., "Preparation of Porous Poly(3-hexylthiophene) by Freeze-Dry Method and Its Application to Organic Photovoltaics," Journal of Applied Polymer Science 122(1):233-240, Oct. 2011.
Huang, W.Y., et al., "Aggregation and Gelation Effects on the Performance of Poly(3-hexylthiophene)/Fullerene Solar Cells," Macromolecules 41(20):7485-7489, Oct. 2008.
Jorcin, J.-B., et al., "CPE Analysis by Local Electrochemical Impedance Spectroscopy," Electrochimica Acta 51(8-9):1473-1479, Jan. 2006.
Kayunkid, N., et al., "Structural Model of Regioregular Poly(3-hexylthiophene) Obtained by Electron Diffraction Analysis," Macromolecules 43(11):4961-4967, Jun. 2010.
Kiel, J.W., et al., "Nanoparticle Agglomeration in Polymer-Based Solar Cells," Physical Review Letters 105(16):168701-1-168701-4, Oct. 2010.
Kiel, J.W., et al., "Nanoparticle Concentration Profile in Polymer-Based Solar Cells," Soft Matter 6(3):641-646, Feb. 2010.
Kim, B.-G., et al., "Effect of Polymer Aggregation on the Open Circuit Voltage in Organic Photovoltaic Cells: Aggregation-Induced Conjugated Polymer Gel and Its Application for Preventing Open Circuit Voltage Drop," ACS Applied Materials and Interfaces 3(3):674-680, Mar. 2011.
Kim, D.H., et al., "Controlled One-Dimensional Nanostructures in Poly(3-hexylthiophene) Thin Film for High-Performance Organic Field-Effect Transistors," Journal of Physical Chemistry B 110(32):15763-15768, Aug. 2006.

(56) References Cited

OTHER PUBLICATIONS

Kim, F.S., et al., "High-Mobility Ambipolar Transistors and High-Gain Inverters From a Donor-Acceptor Copolymer Semiconductor," Advanced Materials 22(4):478-482, Jan. 2010.
Kim, F.S., et al., "One-Dimensional Nanostructures of π-Conjugated Molecular Systems: Assembly, Properties, and Applications From Photovoltaics, Sensors, and Nanophotonics to Nanoelectronics," chemistry of Materials 23(3):682-732, Feb. 2011.
Kitts, C.C., and D.A. Vanden Bout, "The Effect of Solvent Quality on the Chain Morphology in Solutions of Poly(9,9'-dioctylfluorene)," Polymer 48(8)2322-2330, Apr. 2007.
Kline, R.J., et al., "Dependence of Regioregular Poly(3-hexylthiophene) Film Morphology and Field-Effect Mobility on Molecular Weight," Macromolecules 38(8)3312-3319, Apr. 2005.
Kline, S.R., "Reduction and Analysis of SANS and USANS Data Using IGOR Pro," Journal of Applied Crystallography 39(Pt. 6):895-900, Dec. 2006.
Knaapila, M., et al., "Development of Intermolecular Structure and Beta-phase of Random Poly[9,9-bis(2-ethylhexyl) fluorene]-co-(9,9-dioctylfluorene) in Methylcyclohexane," Macromolecules 44(16):6453-6460, Aug. 2011.
Krebs, F.C., "Fabrication and Processing of Polymer Solar Cells: A Review of Printing and Coating Techniques," Solar Energy Materials and Solar Cells 93(4)394-412, Apr. 2009.
Krebs, F.C., et al., "A Round Robin Study of Flexible Large-Area Roll-to-Roll Processed Polymer Solar Cell Modules," Solar Energy Materials and Solar Cells 93(11):1968-1977, Nov. 2009.
Kreyenschmidt, M., et al., "A New Soluble Poly(p-phenylene) With Tetrahydropyrene Repeating Units," Macromolecules 28(13):4577-4582, Jun. 1995.
Lasia, A., "Electrochemical Impedance Spectroscopy and Its Applications," in R.E. White et al. (eds.), "Modern Aspects of Electrochemistry," Kluwer Academic/Plenum Publishers, New York, vol. 32, 1999, pp. 143-248.
Lee, K.H., et al., "Morphology of All-Solution-Processed 'Bilayer' Organic Solar Cells," Advanced Materials 23(6):766-770, Feb. 2011.
Li, G., et al., "High-Efficiency Solution Processable Polymer Photovoltaic Cells by Self-Organization of Polymer Blends," Nature Materials 4(11):864-868, Nov. 2005.
Li, J.-L., et al., "Architecture of a Biocompatible Supramolecular Material by Supersaturation-Driven Fabrication of Its Fiber Network," Journal of Physical Chemistry B 109(51):24231-24235, Dec. 2005.
Li, J.-L., et al., "Microengineering of Supramolecular Soft Materials by Design of the Crystalline Fiber Networks," Crystal Growth & Design 10(6)2699-2706, Jun. 2010.
Lindner, P., "Scattering Experiments," in P. Lindner and T. Zemb (eds.), "Neutrons, X-Rays and Light: Scattering Methods Applied to Soft Condensed Matter," Elsevier Science, Amsterdam, 2002, pp. 23-48.
Liu, X.Y., and P.D. Sawant, "Mechanism of the Formation of Self-Organized Microstructures in Soft Functional Materials," Advanced Materials 14(6):421-426, Mar. 2002.
Mittelbach, P., and G. Porod, "Zur Rantgenkleinwinkelstreuung verdünnter kolloider Systeme. Die Berechnung der Streukurven von Parallelepipeden," Acta Physica Austriaca 14:185-211, 1961.
Newbloom, G.M., et al., "Electrical, Mechanical, and Structural Characterization of Self-Assembly in Poly(3-hexylthiophene) Organogel Networks," Macromolecules 45(8):3452-3462, Apr. 2012.
Newbloom, G.M., et al., "Structure and Property Development of Poly(3-hexylthiophene) Organogels Probed With Combined Rheology, Conductivity and Small Angle Neutron Scattering," Soft Matter 8(34):8854-8864, Sep. 2012.
Oosterbaan, WD, et al., "Alkyl-Chain-Length-Independent Hole Mobility via Morphological Control With Poly(3-alkylthiophene) Nanofibers," Advanced Functional Materials 20(5):792-802, Mar. 2010.
Parnell, A.J., et al., "Nanoscale Phase Separation of P3HT PCMB Thick Films as Measured by Small-Angle X-Ray Scattering," Macromolecules 44(16):6503-6508, Aug. 2011.
Percec, V., et al., "Controlling Polymer Shape Through the Self-Assembly of Dendritic Side-Groups," Nature 391(6663):161-164, Jan. 1998.
Pingree, L.S.C., et al., "The Changing Face of PEDOT:PSS Films: Substrate, Bias, and Processing Effects on Vertical Charge Transport," Journal of Physical Chemistry C 112(21):7922-7927, May 2008.
Plestil, J., et al., "Molecular-Weight Determination From Small-Angle Scattering Without Absolute Intensities: Advantages and Limitations," Journal of Applied Crystallography 24(Pt. 5):659-664, Oct. 1991.
Prosa, T.J., et al., "X-Ray Structural Studies of Poly(3-alkylthiophenes): An Example of an Inverse Comb," Macromolecules 25(17):4364-4372, Aug. 1992.
Ramasubramaniam, R., et al., "Homogeneous Carbon Nanotube/Polymer Composites for Electrical Applications," Applied Physics Letters 83(14):2928-2930, Oct. 2003.
Rice, A.H., et al., "Controlling Vertical Morphology Within the Active Layer of Organic Photovoltaics Using Poly(3-hexylthiophene) Nanowires and Phenyl-$C_{61}$-Butyric Acid Methyl Ester," ACS Nano 5(4):3132-3140, Apr. 2011.
Samitsu, S., et al., "Effective Production of Poly(3-alkylthiophene) Nanofibers by Means of Whisker Method Using Anisole Solvent: Structural, Optical, and Electrical Properties," Macromolecules 41(21):8000-8010, Nov. 2008.
Samitsu, S., et al., "Field-Effect Carrier Transport in Poly(3-alkylthiophene) Nanofiber Networks and Isolated Nanofibers," Macromolecules 43(19):7891-7894, Oct. 2010.
Sandler, J.K.W., et al., "Ultra-Low Electrical Percolation Threshold in Carbon-Nanotube-Epoxy Composites," Polymer 44(19):5893-5899, Sep. 2003.
Shaw, P.E., et al., "Exciton Diffusion Measurements in Poly(3-hexylthiophene)," Advanced Materials 20(18):3516-3520, Sep. 2008.
Sirringhaus, H., et al., "Two-Dimensional Charge Transport in Self-Organized, High-Mobility Conjugated Polymers," Nature 401(6754):685-688, Oct. 1999.
Sobkowicz, M.J., et al., "Effect of Fullerenes on Crystallization-Induced Aggregation in Polymer Photovoltaics aasting Solutions," Macromolecules 45(2):1046-1055, Jan. 2012.
Terech, P., and R.G. Weiss, "Low Molecular Mass Gelators of Organic Liquids and the Properties of Their Gels," Chemical Reviews 97(8):3133-3160, Dec. 1997.
Treat, N.D., et al., "Interdiffusion of PCBM and P3HT Reveals Miscibility in a Photovoltaically Active Blend," Advanced Energy Materials 1(1):82-89, Jan. 2011.
Van Bavel, S., et al., "Relation Between Photoactive Layer Thickness, 3D Morphology, and Device Performance in P3HT/PCBM Bulk-Heterojunction Solar Cells," Macromolecules 42(19):7396-7403, Oct. 2009.
Wang, P.-S., et al., "Gel Formation via Physical Cross-Linking in the Soluble Conjugated Polymer, Poly[2-methoxy-5-(2-ethylhexyloxy)-1,4-phenylenevinylene], in Solution by Addition of Alkanes," Macromolecules 41(17):6500-6504, Sep. 2008.
Wöhrle, D., and D., Meissner, "Organic Solar Cells," Advanced Materials 3(3):129-138, Mar. 1991.
Xin, H., et al., "Highly Efficient Solar Cells Based on Poly(3-butylthiophene) Nanowires," Journal of the American Chemical Society 130(16):5424-5425, Apr. 2008.
Xin, H., et al., "Polymer Nanowire/Fullerene Bulk Heterojunction Solar Cells: How Nanostructure Determines Photovoltaic Properties," ACS Nano 4(4):1861-1872, Apr. 2010.
Xu, W., et al., "Sol—Gel Transition of Poly(3-hexylthiophene) Revealed by Capillary Measurements: Phase Behaviors, Gelation Kinetics and the Formation Mechanism," Soft Matter 8(3):726-733, Jan. 2012.
Yang, H., et al., "Solubility-Driven Thin Film Structures of Regioregular Poly(3-hexyl thiophene) Using Volatile Solvents," Applied Physics Letters 90:172116-172118, Apr. 2007.

(56) References Cited

OTHER PUBLICATIONS

Yang, X., and J. Loos, "Toward High-Performance Polymer Solar Cells: The Importance of Morphology Control," Macromolecules 40(5):1353-1362, Mar. 2007.
Yang, X., et al., "Nanoscale Morphology of High-Performance Polymer Solar Cells," Nano Letters 5(4):579-583, Apr. 2005.
Yin, W., and M. Dadmun, "A New Model for the Morphology of P3HT/PCBM Organic Photovoltaics From Small-Angle Neutron Scattering: Rivers and Streams," ACS Nano 5(6):4756-4768, Jun. 2011.
Yu, G., and A.J. Heeger, "Charge Separation and Photovoltaic Conversion in Polymer Composites With Internal Donor/Acceptor Heterojunctions," Journal of Applied Physics 78(7):4510-4515, Oct. 1995.
Yu, G., et al., "Polymer Photovoltaic Cells: Enhanced Efficiencies via a Network of Internal Donor-Acceptor Heterojunctions," Science 270(5243):1789-1791, Dec. 1995.
Zhang, S., et al., "Design of Nanostructured Biological Materials Through Self-Assembly of Peptides and Proteins," Current Opinion in Chemical Biology 6(6):865-871, Dec. 2002.
Zhang, Y., et al., "A Simple and Effective Way of Achieving Highly Efficient and Thermally Stable Bulk-Heterojunction Polymer Solar Cells Using Amorphous Fullerene Derivatives as Electron Acceptor," Chemistry of Materials 21(13):2598-2600, Jun. 2009.
Zuo, F., et al., "AC Conductivity of Emeraldine Polymer," Physical Review B: Condensed Matter and Material Physics 39(6):3570-3578, Feb. 1989.
Alig, I., et al., "Destruction and Formation of a Carbon Nanotube Network in Polymer Melts: Rheology and Conductivity Spectroscopy," Polymer 49(16):3524-3532, Jul. 2008.
Alig, I., et al., "Destruction and Formation of a Conductive Carbon Nanotube Network in Polymer Melts: In-Line Experiments," Polymer 49(7):1902-1909, Apr. 2008.
Arosio, P., et al., "Ordered Stacking of Regioregular Head-to-Tail Polyalkylthiophenes: Insights From the Crystal Structure of Form I' Poly(3-n-butylthiophene)," Chemistry of Materials 21(1):78-87, Jan. 2009.
Avilés Barreto, S.M., and D. Suleiman, "Synthesis and Characterization of Sulfonated Poly(styrene-isoprene-styrene): Effects of Linear vs. Branched Morphology and Counter-Ion Substitution," Journal of Membrane Science 362(1-2):471-477, Oct. 2010.
Baek, W.-H., et al., "Effect of P3HT:PCBM Concentration in Solvent on Performances of Organic Solar Cells," Solar Energy Materials and Solar Cells 93(8):1263-1267, Aug. 2009.
Balberg, I., and N. Binenbaum, "Computer Study of the Percolation Threshold in a Two-Dimensional Anisotropic System of Conducting Sticks," Physical Review B 28(7):3799-3812, Oct. 1983.
Balberg, I., and N. Binenbaum, "Percolation Thresholds in the Three-Dimensional Sticks System," Physical Review Letters 52(17):1465-1468, Apr. 1984.
Barker, J.G., et al., "Design and Performance of a Thermal-Neutron Double-Crystal Diffractometer for USANS at NIST," Journal of Applied Crystallography 38(6):1004-1011, Dec. 2005.
Basescu, N., et al., "High Electrical Conductivity in Doped Polyacetylene," Nature Letters 327(6121):403-405, Jun. 1987.
Berson, S., et al., "Poly(3-hexylthiophene) Fibers for Photovoltaic Applications," Advanced Functional Materials 17(8):1377-1384, May 2007.
Broadbent, S.R., and J.M. Hammersley, "Percolation Processes: I. Crystals and Mazes," Mathematical Proceedings of the Cambridge Philosophical Society 53(3):629-641, Jul. 1957.
Cabler, S.J.M., "Advisory Circular: Protection of Aircraft Electrical / Electronic Systems Against the Indirect Effects of Lightning," U.S. Department of Transportation, FAA, AC No. 20-136A, Dec. 21, 2006, 29 pages.
Cabler, S.J.M., "Advisory Circular: Protection of Aircraft Fuel Systems Against Fuel Vapor Ignition Caused by Lightning," U.S. Department of Transportation, FAA, ACC No. 20-53B, Jun. 5, 2006, 6 pages.
Carmona, F., et al., "Phénomène de Percolation dans des Matériaux Composites Modeles," Revue de Chimie Minérale [Inorganic Chemistry Review] 18(5):498-508,1981 (English abstract).
Chan, K.L., et al., "Effects of the Size and Filler Loading on the Properties of Copper- and Silver-Nanoparticle-Filled Epoxy Composites," Journal of Applied Polymer Science 121(6):3145-3152, Sep. 2011.
Chapartegui, M., et al., "Specific Rheological and Electrical Features of Carbon Nanotube Dispersions in an Epoxy Matrix," Composites Science and Technology 70(5):879-884, May 2010.
Chiang, C.K., et al., "Electrical Conductivity in Doped Polyacetylene," Physical Review Letters 39(17):1098-1101, Oct. 1977.
Devižis, A., et al., "Hierarchical Charge Carrier Motion in Conjugated Polymers," Chemical Physics Letters 498(4-6):302-306, Oct. 2010.
Fan, A.M., and G. Alexeeff, "Nanotechnology and Nanomaterials: Toxicology, Risk Assessment, and Regulations," Journal of Nanoscience and Nanotechnology 10(12):8646-8657, Dec. 2010.
Fisher, F.A., et al., "Aircraft Lightning Protection Handbook," U.S. Department of Transportation, FAA, Sep. 1989, 503 pages.
Gardiner, G., "Lightning Strike Protection for Composite Structures," CompositesWorld.com, Jul. 1, 2006, <http://www.compositesworld.com/articles/lightning-strike-protection-for-composite-structures> [retrieved Nov. 25, 2014], 7 pages.
Grell, M., et al., "Interplay of Physical Structure and Photophysics for a Liquid Crystalline Polyfluorene," Macromolecules 32(18):5810-5817, Sep. 1999.
Gurland, J., "An Estimate of Contact and Continuity of Dispersions in Opaque Samples," Transactions of the Metallurgical Society of AIME 236:642-646, May 1966.
Hale, J., "Boeing 787 From the Ground Up," Aero Quarterly 24(Quarter 4):17-23, 2006.
Hugger, S., et al., "Semicrystalline Morphology in Thin Films of Poly(3-hexylthiophene)," Colloid & Polymer Science 282(8):932-938, Jun. 2004.
Ihn, K.J., et al., "Whiskers of Poly(3-alkylthiophene)s," Journal of Polymer Science: Part B: Polymer Physics 31(6):735-742, May 1993.
Ito, T., et al., "Simultaneous Polymerization and Formation of Polyacetylene Film on the Surface of Concentrated Soluble Ziegler-Type Catalyst Solution," Journal of Polymer Science: Polymer Chemistry Edition 12(1):11-20, Jan. 1974.
Ivanov, E., et al., "Effects of Processing Conditions on Rheological, Thermal, and Electrical Properties of Multiwall Carbon Nanotube/Epoxy Resin Composites," Journal of Polymer Science Part B: Polymer Physics 49(6):431-442, Mar. 2011.
Jing, X., et al., "The Effect of Particle Size on Electric Conducting Percolation Threshold in Polymer/Conducting Particle Composites," Journal of Materials Science Letters 19(5)377-379, Mar. 2000.
Jo, J., et al., "Time-Dependent Morphology Evolution by Annealing Processes on Polymer: Fullerene Blend Solar Cells," Advanced Functional Materials 19(6):866-874, Mar. 2009.
Kang, E.T., et al., "Polyaniline: A Polymer With Many Interesting Intrinsic Redox States," Progress in Polymer Science 23(2):277-324, 1998.
Kao, C.Y., et al., "Doping of Conjugated Polythiophenes With Alkyl Silanes," Advanced Functional Materials 19(12):1906-1911, Jun. 2009.
Khalkhal, F., and P.J. Carreau, "Scaling Behavior of the Elastic Properties of Non-Dilute MWCNT-Epoxy Suspensions," Rheologica Acta 50(9-10):717-728, Oct. 2011.
Kim, J., et al., "Thermal and Electrical Conductivity of $Al(OH)_3$ Covered Graphene Oxide Nanosheet/Epoxy Composites," Journal of Material Science 47(3):1418-1426, Feb. 2012.
Kim, J.Y., and C.D. Frisbie, "Correlation of Phase Behavior and Charge Transport in Conjugated Polymer/Fullerene Blends," Journal of Physical Chemistry C 112(45):17726-17736, Nov. 2008.
Kim, Y.J., et al., "Electrical Conductivity of Chemically Modified Multiwalled Carbon Nanotube/Epoxy Composites," Carbon 43(1):23-30,2005.

(56) References Cited

OTHER PUBLICATIONS

Kirchmeyer, S., and K. Reuter, "Scientific Importance, Properties and Growing Applications of Poly(3,4-ethylenedioxythiophene)," Journal of Materials Chemistry 15(21):2077-2088,2005.
Kirkpatrick, S., "Percolation and Conduction," Reviews of Modern Physics 45(4):574-588, Oct. 1973.
Knaapila, M., et al., "Network Structure of Polyfluorene Sheets as a Function of Alkyl Side Chain Length," Physical Review E 83(5):051803-1-051803-11, May 2011.
Koppe, M., et al., "Influence of Molecular Weight Distribution on the Gelation of P3HT and Its Impact on the Photovoltaic Performance," Macromolecules 42(13):4661-4666, Jul. 2009.
Lang, U., et al., "Microscopical Investigations of PEDOT:PSS Thin Films," Advanced Functional Materials 19(8):1215-1220, Apr. 2009.
Larson-Smith, K., and D.C. Pozzo, "Scalable Synthesis of Self-Assembling Nanoparticle Clusters Based on Controlled Steric Interactions," Soft Matter 7(11):5339-5347, 2011.
Larson-Smith, K., et al., "SANS and SAXS Analysis of Charged Nanoparticle Adsorption at Oil-Water Interfaces," Langmuir 28(5):2493-2501, Feb. 2012.
Li, J.-L., and X.-Y. Liu, "Architecture of Supramolecular Soft Functional Materials: From Understanding to Micro-/Nanoscale Engineering," Advanced Functional Materials 20(19):3196-3216, Oct. 2010.
Li, Y.-C., et al., "Fractal Aggregates of Conjugated Polymer in Solution State," Langmuir 22(26):11009-11015, Dec. 2006.
"Lightning Strike Protection for Carbon Fiber Aircraft," Dexmet Corporation, Wallingford, Conn., Literature:# dexmet_001, Oct. 5, 2010, 12 pages.
Lin, C.-R., et al., "A Links-Nodes-Blobs Model for Conductive Polymer Composites," Macromolecular Theory and Simulations 10(4):219-224, Apr. 2001.
Lin, Z.-Q., et al., "Preparation and Characterization of Polyfluorene-Based Supramolecular π-Conjugated Polymer Gels," Journal of Physical Chemistry C 115(11):4418-4424, Mar. 2011.
Liu, J., et al., "Controlling Poly(3-hexylthiophene) Crystal Dimension: Nanowhiskers and Nanoribbons," Macromolecules 42(24):9390-9393, Dec. 2009.
MacDiarmid, A.G., "'Synthetic Metals': A Novel Role for Organic Polymers (Nobel Lecture)," Angewandte Chemie (International Edition) 40(14):2581-2590, Jul. 2001.
Extended European Search Report Report mailed Sep. 28, 2015, issued in corresponding International Application No. PCT/US2013/034835, filed Apr. 4, 2013, 5 pages.
Malik, S., and A.K. Nandi, "Crystallization Mechanism of Regioregular Poly(3-alkyl thiophene)s," Journal of Polymer Science. Part B: Polymer Physics 40(18):2073-2085, Sep. 2002.
Malik, S., and A.K. Nandi, "Influence of Alkyl Chain Length on the Gelation Mechanism of Thermoreversible Gels of Regioregular Poly(3-alkyl thiophenes) in Xylene," Journal of Applied Polymer Science 103(4):2528-2537, Feb. 2007.
Malik, S., and A.K. Nandi, "Thermodynamic and Structural Investigation of Thermoreversible Poly(3-dodecyl thiophene) Gels in the Three Isomers of Xylene," Journal of Physical Chemistry B 108(2):597-604, Jan. 2004.
Malik, S., et al., "Thermoreversible Gelation of Regioregular Poly(3-hexylthiophene) in Xylene," Macromolecules 34(2):275-282, Jan. 2001.
Martin, D.C., et al., "The Morphology of Poly(3,4-ethylenedioxythiophene)," Polymer Reviews 50(3):340-384, 2010.
Merlo, J.A., and C.D. Frisbie, "Field Effect Transport and Trapping in Regioregular Polythiophene Nanofibers," Journal of Physical Chemistry B 108(50):19169-19179, Dec. 2004.
Millstone, J.E., et al., "Synthesis, Properties, and Electronic Applications of Size-Controlled Poly(3-hexylthiophene) Nanoparticles," Langmuir 26(16):13056-13061, Aug. 2010.
Moulé, A.J., and K. Meerholz, "Morphology Control in Solution-Processed Bulk-Heterojunction Solar Cell Mixtures," Advanced Functional Materials 19(19):3028-3036, Oct. 2009.
Munson-McGee, S.H., "Estimation of the Critical Concentration in an Anisotropic Percolation Network," Physical Review B 43(4):3331-3336, Feb. 1991.
Newbloom, G.M., et al., "Mesoscale Morphology and Charge Transport in Colloidal Networks of Poly(3-hexylthiophene)," Macromolecules 44(10):3801-3809, May 2011.
Obrzut, J., and K.A. Page, "Electrical Conductivity and Relaxation in Poly(3-hexylthiophene)," Physical Review B 80(19):195211-1-195211-7, Nov. 2009.
Ospinal-Jiménez, M., and D.C. Pozzo, "Structural Analysis of Protein Complexes With Sodium Alkyl Sulfates by Small-Angle Scattering and Polyacrylamide Gel Electrophoresis," Langmuir 27(3):928-935, Feb. 2011.
Pike, G.E., and C.H. Seager, "Percolation and Conductivity: A Computer Study. I," Physical Review B 10(4):1421-1434, Aug. 1974.
Plumer, J.A., and J.D. Robb, "The Direct Effects of Lightning on Aircraft," IEEE Transactions on Electromagnetic Compatability EMC-24(2):158-172, May 1982.
Porcar, L., et al., "Rheo—Small-Angle Neutron Scattering at the National Institute of Standards and Technology Center for Neutron Research," Review of Scientific Instruments 82(8):083902-1-083902-7, Aug. 2011.
Pozzo, D.C., and L.M. Walker, "Macroscopic Alignment of Nanoparticle Arrays in Soft Crystals of Cubic and Cylindrical Polymer Micelles," European Physical Journal E: Soft Matter 26(1-2):183-189, May-Jun. 2008.
Pozzo, D.C., and L.M. Walker, "Reversible Shear Gelation of Polymer—Clay Dispersions," Colloids and Surfaces A: Physicochemical and Engineering Aspects 240(1-3):187-198, Jun. 2004.
Pozzo, D.C., and L.M. Walker, "Shear Orientation of Nanoparticle Arrays Templated in a Thermoreversible Block Copolymer Micellar Crystal," Macromolecules 40(16):5801-5811, Aug. 2007.
Pozzo, D.C., and M. Matos, "Structure-Property Relationships of Nanocomposites Incorporating Self-Assembled Conductive Polymer Networks," Proposal submitted to Grant Opportunities for Academic Liaison with Industry (GOALI), Feb. 13, 2012, 22 pages [redacted].
Richards, J.J., et al., "Aqueous Dispersions of Colloidal poly(3-hexylthiophene) Gel Particles With High Internal Porosity," Journal of Colloid and Interface Science 364(2):341-350, Dec. 2011.
Roncali, J., "Conjugated Poly(thiophenes): Synthesis, Functionalization, and Applications," Chemical Reviews 92(4):711-738, Jun. 1992.
Saini, V., et al., "Electrical, Optical, and Morphological Properties of P3HT-MWNT Nanocomposites Prepared by In Situ Polymerization," Journal of Physical Chemistry 113(19):8023-8029, May 2009.
Samitsu, S., et al., "Nanofiber Preparation by Whisker Method Using Solvent-Soluble Conducting Polymers," Thin Solid Films 516(9):2478-2486, Mar. 2008.
Sanjinés, R., et al., "Electrical Properties and Applications of Carbon Based Nanocomposite Materials: An Overview," Surface & Coatings Technology 206(4):727-733, Nov. 2011.
Shaktawat, V., et al., "Electrical Conductivity and Optical Band Gap Studies of Polypyrrole Doped With Different Acids," Journal of Optoelectronics and Advanced Materials 9(7)2130-2132, Jul. 2007.
"Silver-Filled Polyurethane Conductive Flexible Coating: CHO-SHIELD® 4994," Product Information TB 1032 EN, Parker/Chomerics, Woburn, Mass., Jul. 2013, 2 pages.
Glatter, V.O., and O. Kratky (eds.), "Small Angle X-Ray Scattering," Academic Press Inc., London, 1982.
Teixeira, J., "Small-Angle Scattering by Fractal Systems," Journal of Applied Crystallography 21(6):781-785, Dec. 1988.
Verilhac, J.-M., et al., "Effect of Macromolecular Parameters and Processing Conditions on Supramolecular Organisation, Morphology and Electrical Transport Properties in Thin Layers of Regioregular Poly(3-hexylthiophene)," Synthetic Metals 156(11-13):815-823, Jun. 2006.
Wang, R.-Y., et al., "Architecture of Fiber Network: From Understanding to Engineering of Molecular Gels," Journal of Physical Chemistry B 110(51)25797-25802, Dec. 2006.

(56) References Cited

OTHER PUBLICATIONS

Weber, M., and M.R. Kamal, "Estimation of the Volume Resistivity of Electrically Conductive Composites," Polymer Composites 18(6):711-725, Dec. 1997.
Weigandt, K.M., et al., "In Situ Neutron Scattering Study of Structural Transitions in Fibrin Networks Under Shear Deformation," Soft Matter 7(21):9992-10000, Nov. 2011.
Wu, P.-T., et al., "Regioregular Poly(3-pentylthiophene): Synthesis, Self-Assembly of Nanowires, High-Mobility Field-Effect Transistors, and Efficient Photovoltaic Cells," Macromolecules 42(22):8817-8826, Nov. 2009.
Zhao, J., et al., "Phase Diagram of P3HT/PCBM Blends and Its Implication for the Stability of Morphology," Journal of Physical Chemistry B 113(6):1587-1591, Feb. 2009.
Zoltowski, P., "The Power of Reparametrization of Measurement Models in Electrochemical Impedance Spectroscopy," Journal of Electroanalytical Chemistry 424(1-2):173-178, Mar. 1997.
International Search Report mailed Jul. 30, 2013, issued in corresponding International Application No. PCT/US2013/034835, filed Apr. 1, 2013, 2 pages.
Luong, N.D., et al., "Self-Assembled Tetramethylbenzidine Conductive Nanofibers Synchronized With Gold Nanoparticle Formation," Applied Surface Science 257(8):3233-3235, Feb. 2011.

* cited by examiner

Polythiophene
P3HT: R = Hexyl

Polyfluorenes
PFO: R = Octyl

COMPOSITES INCORPORATED A CONDUCTIVE POLYMER NANOFIBER NETWORK

CROSS-REFERENCE TO RELATED APPLICATION

This application claims the benefit of U.S. Provisional Application No. 61/618,126, filed Mar. 30, 2012, the disclosure of which is hereby incorporated by reference in its entirety.

STATEMENT OF GOVERNMENT LICENSE RIGHTS

This invention was made with government support under contract number DESC0005153, awarded by the U.S. Department of Energy. The government has certain rights in the invention.

BACKGROUND

Carbon fiber reinforced composites (CFRC) result in significant reductions in weight due to their lower density (1.5-1.8 g/cm$^3$) when compared to aluminum alloys (2.7 g/cm$^3$). CFRC are particularly of interest in the manufacture of vehicles, including airplanes and land vehicles such as cars and trucks. Furthermore, the use of composites simplifies manufacturing processes and leads to stronger components with higher durability. Expected increases in fuel costs will continue to motivate the use of composites in vehicle designs in the future.

Despite having clear advantages in weight reduction and fuel savings, the use of resin-based composites in modern vehicles presents new engineering challenges. Some of these stem from the dielectric nature of the resins that are used to prepare the CFRC. Traditional metallic components have high conductivity (Aluminum ~$3.6\times10^7$ S/m). Carbon fibers in CFRC significantly increase the effective conductivity (CFRC ~$1.5\times10^4$ S/m) but, because they are buried inside the material, large currents can cause structural damage. For these reasons, electromagnetic effect (EME) management of CFRC in vehicles (particularly airplanes) is especially important.

In particular, the mitigation of risks associated with lightning strikes is of high relevance to aircraft design. It is estimated that FAA-approved commercial airplanes are struck by lightning an average of two times every year. The primary lightning event (main stroke) requires dissipation of up to 200,000 Amperes over sub-millisecond timescales. When a suitable conductive path is not present, mechanical damage, thermal degradation and/or damage to electronic components can result. Moreover, lightning-related events such as corona discharge, streamers, and continuing currents can also persist before or after the main stroke exits the airplane. These events can result in serious damage to physical and electronic components even when not in the exit path of the main stroke. For example, continuing currents can also be significant (up to 200 Amperes) and need to be dissipated effectively.

The other main EME problem of importance is static charge buildup during normal flight conditions. Static charge can originate from the impact of airborne particles, rain or snow (i.e. triboelectric charging) or from the flow of hydraulic fluids or fuel. Static charge buildup hinders communications, interferes with electronic equipment and can lead to sparks and explosions in the presence of flammable vapors.

The increased use of electronic navigation systems in modern aircrafts (e.g. fly-by-wire) that may be affected by static buildup further motivates the need for effective charge dissipation.

Current strategies for lightning and EME management in planes containing CFRCs consist of incorporating a conductive metallic mesh (e.g. Cu or Al) between upper plies of the composite. This allows effective current dissipation along the surface of the plane without penetrating deep into the composite material. Although this is an effective damage prevention strategy, it can add significant weight to the plane (Cu density is 8.9 g/cm$^3$), reducing the magnitude of fuel savings. For this reason, metallic meshes are only added to critical sections of the planes such as those with high probability of lightning strike or where damage can be critical (e.g. fuel tanks).

A more powerful mitigation strategy that is also being explored is the use of conductive finishes (i.e. coatings) on the upper surfaces of the plane.

Because of their location, sacrificial conductive coatings can potentially dissipate enough electric current to prevent more serious damage to underlying structural and electronic components. Although lightning will irreversibly damage the coatings, these can be easily removed and reapplied. In contrast, damage to composite parts requires full replacement of the affected area at a much higher cost. Current commercial conductive finishes are usually composed of silver or copper particles dispersed within epoxy, acrylic or polyurethane carriers. The use of metallic particles leads to low sheet resistances (~0.1 Ohm/sq for 0.05 mm thickness) but the creation of a connected conductive path (percolation) requires very high particle loadings (>50 wt %). This also translates to very large mass densities (>4 g/cm$^3$) for the resulting coatings, adding to the total aircraft weight and reducing fuel savings. More importantly, the high particle loading requirements significantly deteriorate the mechanical and adhesive properties of the coatings so that they may not meet aerospace requirements.

Ideally, one would create conductive finishes that have low sheet resistances, low mass densities and which do not affect the adhesive and mechanical properties of existing coatings that have been optimized for this application. Conductive nanomaterials have been proposed as possible conductive finishes. The dispersion of conductive nanomaterials including carbon nanotubes, graphene, and nanoparticles into organic resins has been explored in order to modify the electronic properties of composite materials. Although some of these strategies show substantial promise, there are also significant problems preventing their application in conductive finishes. For example, carbon nanotubes have low percolation thresholds (~0.5 wt %) and show significant increases in conductivity at higher concentrations (e.g. ~0.2 S/m at 1 wt %). However, these changes are also followed by large increases in viscosity that makes coating difficult. There are also concerns about the toxicity of nanotubes and the potential for stronger regulation in the future.

Therefore, improved conductive finishes are desirable in order to advance the production of CFRCs and similar technologies.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In one aspect, a method of forming a composite incorporating networks of conductive polymer nanofibers is provided. In one embodiment, the method includes the steps of:

(a) providing a colloidal dispersion comprising a self-assembled network of a conjugated polymer;

(b) doping the conjugated polymer with a chemical dopant to provide conductive polymers within the self-assembled network of the colloidal dispersion; and (c) dispersing the colloidal dispersion within a liquid matrix to provide a liquid composite comprising a network of conjugated polymer nanofibers, wherein the liquid matrix is selected from the group consisting of a polymer and a polymer precursor.

In another aspect, an electromagnetic effect (EME) management system for a vehicle exterior is provided. In one embodiment, the EME management system includes:

an exterior surface of a vehicle; and a composite layer disposed on the exterior surface, the composite layer comprising a network of conductive polymer nanofibers in a solid polymer matrix.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Methods of forming composites that incorporate networks of conductive polymer nanofibers are provided. Networks of less-than conductive polymers are first formed and then doped with a chemical dopant to provide networks of conductive polymers. The networks of conductive polymers are then incorporated into a matrix in order to improve the conductivity of the matrix.

In one aspect, a method of forming a composite incorporating networks of conductive polymer nanofibers is provided. In one embodiment, the method includes the steps of:

(a) providing a colloidal dispersion comprising a self-assembled network of a conjugated polymer;

(b) doping the conjugated polymer with a chemical dopant to provide conductive polymers within the self-assembled network of the colloidal dispersion; and (c) dispersing the colloidal dispersion within a liquid matrix to provide a liquid composite comprising a network of conjugated polymer nanofibers, wherein the liquid matrix is selected from the group consisting of a polymer and a polymer precursor.

Figure 1A:
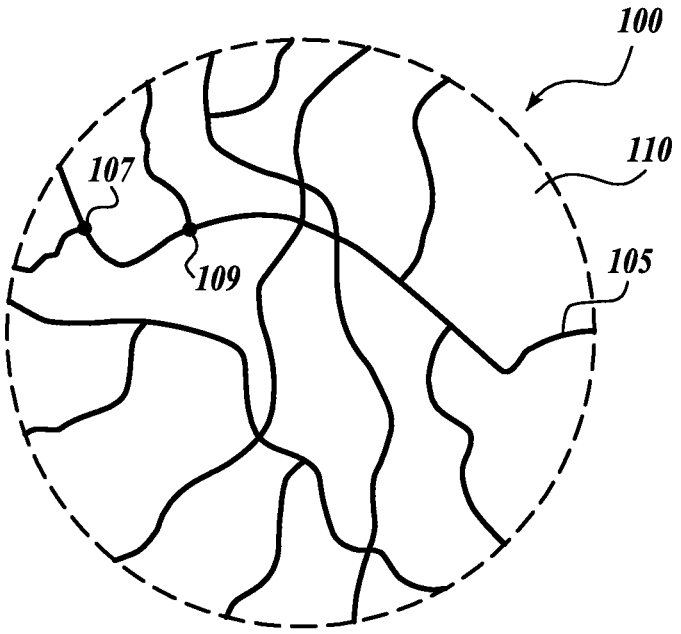
FIGS. 1A-1D schematically illustrate representative methods of forming composites incorporating polymer nanofiber networks in accordance with the disclosed embodiments.
Figure 1B:
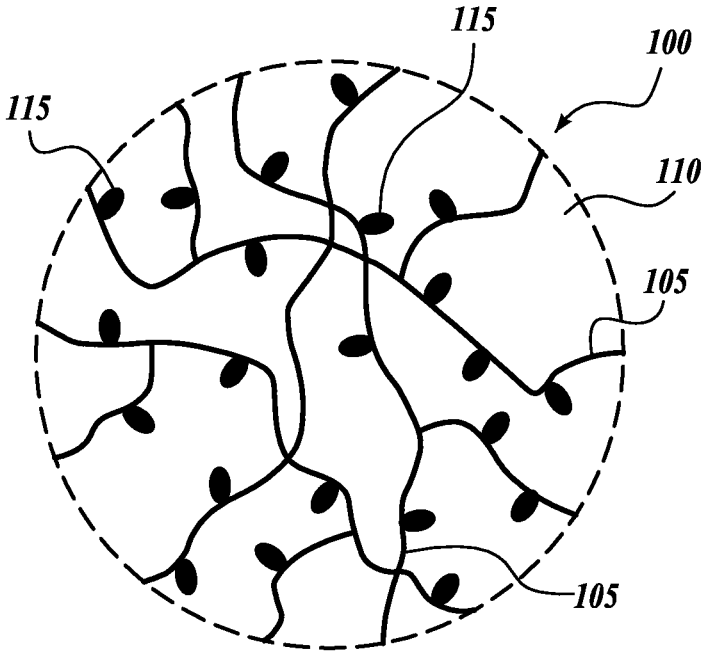
Figure 1C:
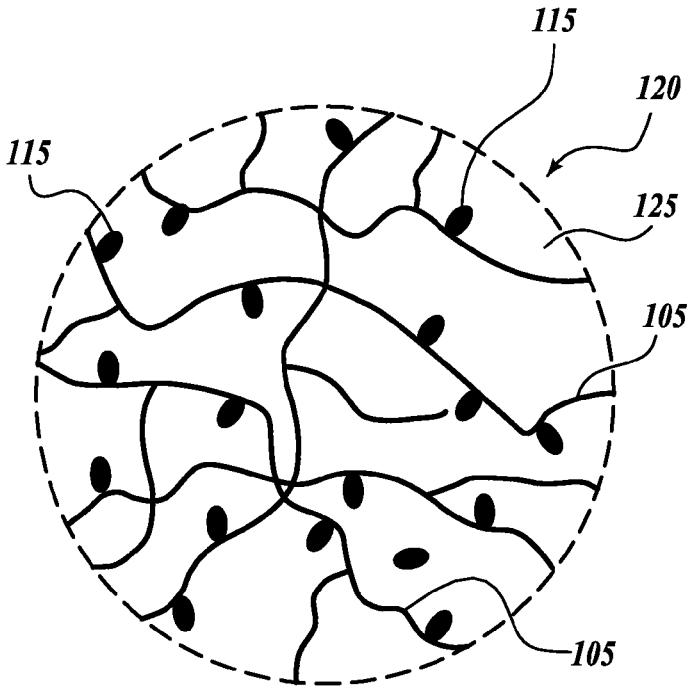

The disclosed methods may be better understood with reference to the experimental descriptions below, as well as the attached FIGURES. Referring to FIGS. 1A-1C, the steps of the method will be described.

FIG. 1A illustrates a colloidal dispersion 100 comprising a self-assembled network of conjugated polymer nanofibers 105 in a solvent 110. The composition of the colloidal dispersion 100 will be described in greater detail below.

"Colloidal dispersion" is defined as a conjugated polymer network structure that is suspended in a solvent. This suspended structure in its entirety can be on the order of 100 nm or larger, but may contain components that exist on a much smaller size scale (i.e. some conjugated polymers form fiber that are on the order of 5 nm in thickness and 20 nm in width). The smaller, interconnected components make up the larger network structure that is suspended in the solvent.

Referring to FIG. 1B, the colloidal dispersion 100 of FIG. 1A is then doped with a chemical dopant 115, which has the effect of increasing the conductivity of the nanofibers and the colloidal dispersion 100.

Referring to FIG. 1C, the colloidal dispersion 100 of FIG. 1B is then transferred to and dispersed in a liquid matrix 125 to provide a liquid composite 120 comprised of a network of conductive polymer nanofibers. The liquid matrix 125 includes a polymer or a polymer precursor.

In one embodiment, the network of conductive polymers comprises fibers having an individual length of from 50 nm to 5 microns.

In one embodiment, the network of conductive polymers comprises fibers having a cross-sectional dimension of from 5 nm to 200 nm.

In one embodiment, the network of conductive polymers comprises fibers having a plurality of branch points spaced between 200 nm to 5 microns apart. As used herein, "branch points" refers to the locations along a polymer chain 105 where the polymer branches into side chains. Referring to FIG. 1A, branches are illustrated at 107 and 109. The distance between branch points is the distance between 107 and 109.

In one embodiment, the colloidal dispersion is from 1 micron to 1 mm in size. The size of the colloidal dispersion is defined by its largest measurable dimension (e.g., width). The shape of typically colloidal dispersions is irregular.

Figure 1D:
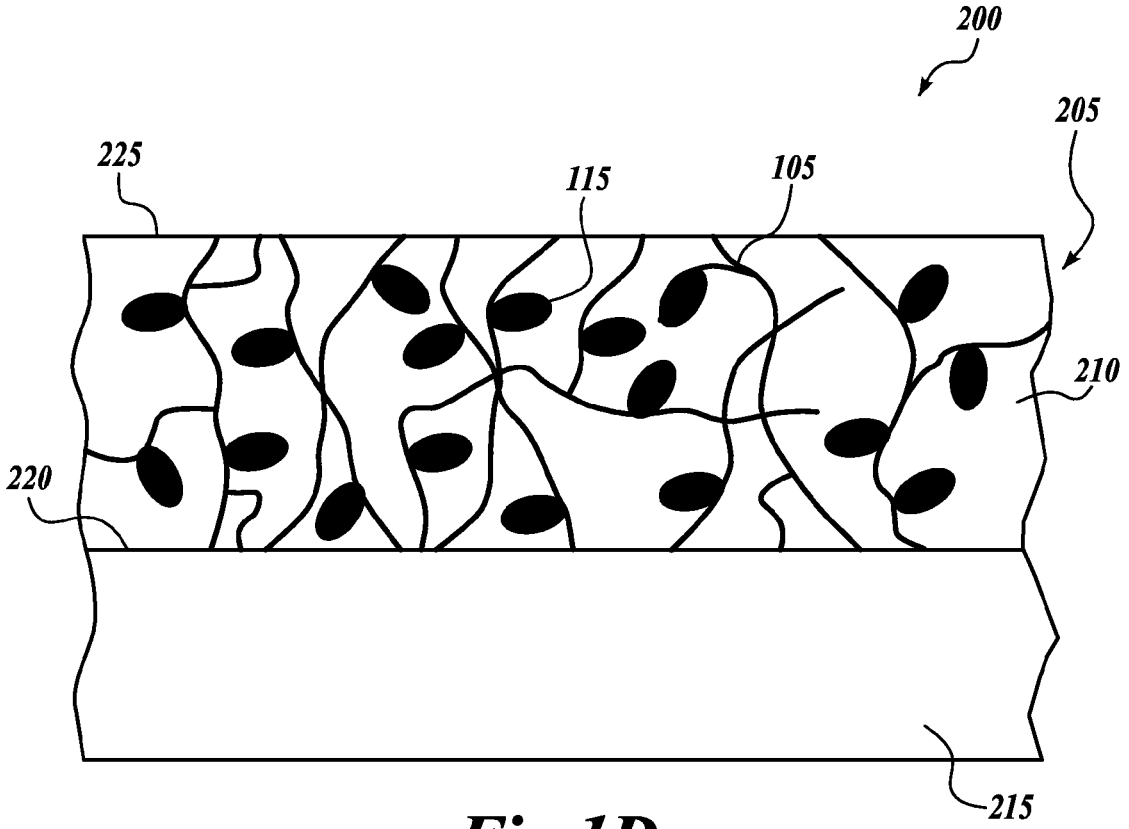

In one embodiment, the method further comprises a step of solidifying the liquid composite to provide a solid composite comprising a network of conjugated polymer nanofibers in a solid polymer matrix. Referring to FIG. 1D, the liquid composite 120 of FIG. 1C can then be applied to a substrate 215 in order to form a solid composite 205. The solid composite 205 includes a solid polymer matrix 210 that is the solidified embodiment of the liquid matrix 125 from FIG. 1C (e.g., a polymerized polymer precursor or a solidified polymer). The solid composite 205 also includes conductive polymers comprising a conjugated polymer nanofiber network 105 doped with chemical dopants 115. The combined assembly 200 provides a conductive surface to the substrate 215 that includes a plurality of conductive paths, via the nanofiber network 105 from the substrate surface 220 to the composite surface 225.

In the representative embodiment where the substrate 215 is a vehicle exterior surface, the solid composite 205 provides an EME management layer. Representative substrates 215 include non-conductive structural materials, such as CRFCs. Representative vehicles include airplanes and automobiles (e.g., cars, trucks, and motorcycles).

The disclosed embodiments use conjugated polymer nanostructures as additives to generate finishes for electromagnetic effect (EME) management applications on carbon fiber reinforced composites (CFRC). Conjugated polymers (CP) have delocalized electrons in $\pi$ orbitals along the backbone. Charge transport can occur along the chain by resonant transfer or via inter-chain "hopping" when polymers are packed sufficiently close to each other (e.g. via $\pi$-$\pi$ stacking in nanofibers).

Conjugated polymers are not considered "conductive polymers" for the purposes of this disclosure, unless doped with a chemical dopant. In this regard, "conductive polymers" incorporated into a nanofiber network and including the chemical dopant, have a conductivity of $10^{-9}$ S/sq or greater (i.e., $10^{9}$ Ohm/sq or less).

Representative CPs include polythiophenes, polyfluorenes, polyacetylene, polyanililine and polyphenylenes with various substitution moieties (e.g. alkanes) that are added to improve solubility in organic solvents. In one embodiment, the conjugated polymer is a semiconducting polymer. Conjugated polymers by themselves are typically, at the most, semiconducting. Therefore, conjugated polymers must be doped, as provided herein, in order to become sufficiently conductive to form a conductive composite.

In one embodiment, the conjugated polymer is organic-soluble. As used herein, the term "organic soluble" refers to a conjugated polymer that can dissolve in an organic solvent at concentrations that are equal or greater than 0.1 mg/mL.

In one embodiment, the conjugated polymer is selected from the group consisting of a polyalkylthiophene, a polydialkyl fluorene, a polydithienosilole, a polyphenylene, a poly(3,4-ethylenedioxythiophene), a poly(pyrrole), a polypyrene, a polypyridine, a poly(p-phenylene vinylene), a polycarbazole, a polyaniline, a polyindole, and a copolymer of the polymers listed within this group.

Figure 2:
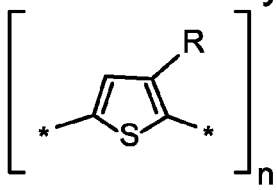
FIG. 2 illustrates representative conjugated polymers useful in the disclosed embodiments.
Figure 2:
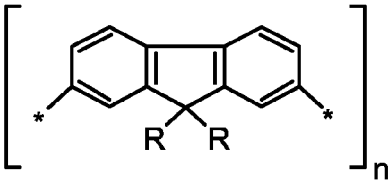

FIG. 2 shows chemical structures of two representative CP types useful in the disclosed embodiments: polythiophene (e.g. P3HT) and polyfluorene (e.g. PFO).

Although largely unexplored in this context, CPs have potential advantages for the creation of advanced conductive finishes for CFRC in various applications, including the aerospace industry. First, their density (~1.1 g/cm$^3$) matches that of the resins so that they do not add significant weight to the coating. Their chemical nature also results in favorable chemical interactions with resin monomers so that they are stable in dispersion.

CPs useful in the provided embodiments possess strong tendencies to self-assemble into long nanofibers and to form networked nanostructures. The self-assembly process is usually triggered by the reduction of the polymer solubility and it is readily controlled by changing temperature or by adding miscible non-solvents. The formation of these supra-molecular nanostructures through self-assembly leads to sufficient electronic percolation and to effective charge propagation.

Figure 3:
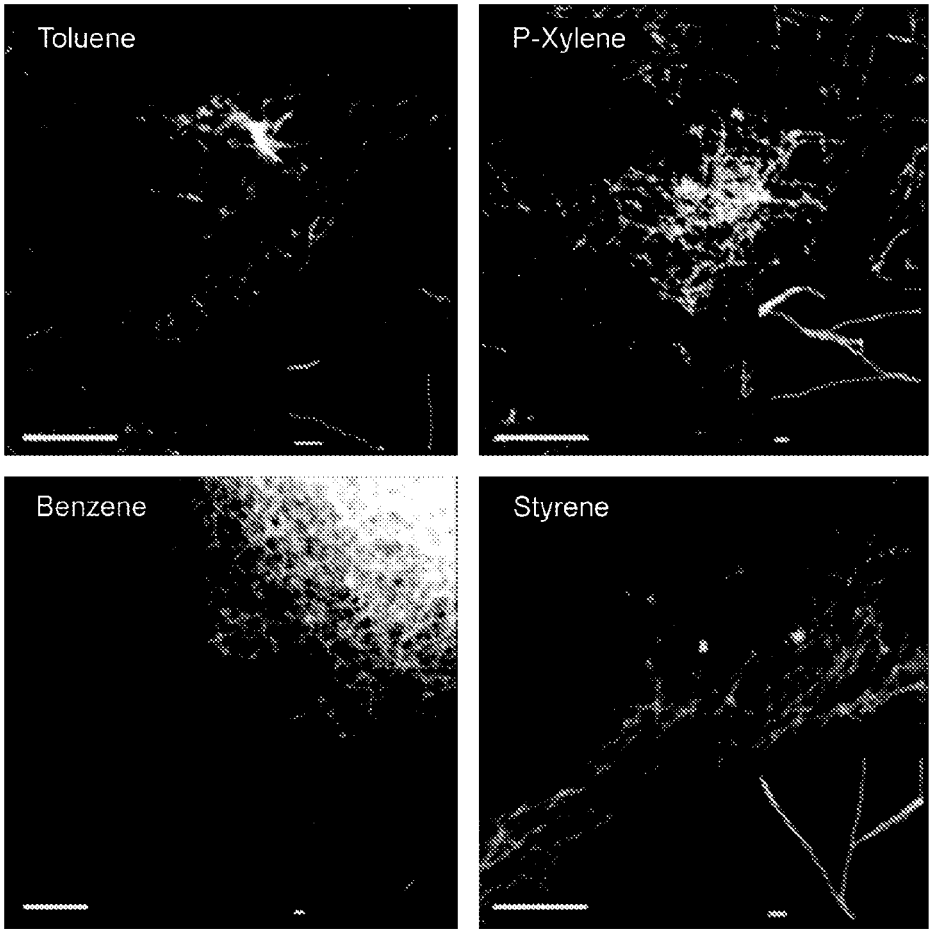
FIG. 3 illustrates TEM micrographs of P3HT nanofiber networks self-assembled in various solvents.

Several CPs, including P3HT and PFO have been shown to readily form stable nanofiber network dispersions and organogels when dissolved in aromatic solvents at variable temperatures. Nanofiber networks and organogels provide clear paths for charge transport over long distances because they are intrinsically connected. Furthermore, inducing self-assembly under different conditions readily modifies the structural parameters of the nanofiber network including the branching density (FIG. 3).

Network structures and gels have also been observed in several other CP systems suggesting that it is a common effect that originates from $\pi$-$\pi$ stacking interactions. The formation of self-assembled fibers and networks can result in multiple-order increases in conductivity due to increased conjugation length, crystalline order and percolation.

In one embodiment, the colloidal dispersion is formed by temperature-induced self-assembly of the conjugated polymer in a solution.

In one embodiment, the colloidal dispersion is a fluid colloidal dispersion.

In one embodiment, the colloidal dispersion is prepared from the mechanical fracture of a gel.

In one embodiment, the gel is an elastic organogel comprising the self-assembled network of the conjugated polymer.

There is a strong correlation between the state of organization of the CPs and their electronic properties. Lastly, because they are normally p-type semiconductors, the intrinsic conductivity of CPs is initially low but can increase by multiple orders of magnitude upon oxidative doping. Conductivities of up to 20 kS/cm have been reported for doped polyacetylene.

Figure 4:
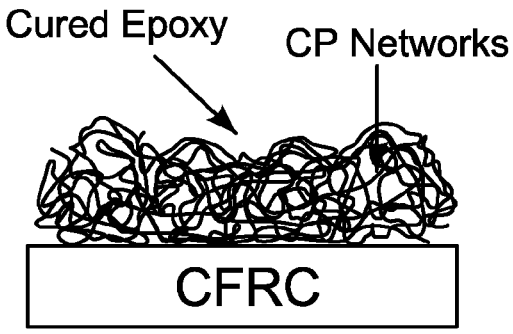
FIG. 4 illustrates the formation of stable networks of P3HT in epoxy (BADGE) in accordance with the disclosed embodiments.

FIG. 4 schematically shows a representative approach useful to generate all-organic conductive coatings. FIG. 4 also shows P3HT nanofiber network dispersions in epoxy carriers and cured coatings.

In certain embodiments, the disclosed composites are useful for the dissipation of currents arising from EME events related to static charge buildup and lightning (e.g. corona discharge, streamers and continuing currents). One advantage of these conductive additives is that they can be easily incorporated into CFRC finishes of vehicles (e.g., airplanes) so that most exposed areas of the vehicle could benefit from EME protection. In one embodiment, the liquid matrix is selected from the group consisting of a polymerizable resin, an oil-based paint, and an oil-based primer.

Accordingly, in another aspect, an electromagnetic effect (EME) management system for a vehicle exterior is provided. In one embodiment, the EME management system includes:

an exterior surface of a vehicle; and a composite layer disposed on the exterior surface, the composite layer comprising a network of conductive polymer nanofibers in a solid polymer matrix.

In one embodiment, the solid polymer matrix is configured to be applied to the exterior surface as a liquid coating.

In certain embodiments, the CP nanostructures can be added directly to existing formulations (e.g. polyurethanes or epoxies) that have been optimized for mechanical properties, adhesion, durability, and cure-time so that commercial implementation is straightforward.

Some CPs formulations, such as poly(3,4-ethylenedioxythiophene) doped with poly(styrene sulfonate) (PEDOT:PSS; BaytronP from Bayer) have been used in antistatic applications and in transparent coatings for organic solar cells and electronic displays. However, these coatings are usually composed of pure PEDOT:PSS so that film properties (e.g. adhesion) are largely determined by the CP and are not adequate for vehicle finishes. PEDOT:PSS is also insoluble in most solvents and application is normally in the form of spherical particle dispersions where there is little ability to optimize the morphology and where high weight fractions are necessary to achieve percolation. In contrast, polythiophenes (e.g. P3HT) and organic-soluble CPs show rich structural behavior that can translate into significant improvements in electronic properties (e.g. nanofiber networks shown in FIG. 3).

Procedures for Making Representative Composites

Step 1: Preparation of Fiber Network Dispersions from Conjugated Polymers

Scheme 1: Colloidal Dispersions Self-Assembled Using Temperature Change

First, a conjugated polymer such as, poly-3-alkyl-thiophene (e.g., poly-3-hexyl-thiophene; P3HT), poly di-alkyl fluorene, poly dithienosilole vinylene, or poly dithienosilole thiazolothiazole thiophene, is dissolved in an organic solvent that can be composed of a pure aromatic molecule (e.g. xylene, toluene, or benzene), an alkane (e.g. decane, dodecane, or hexadecane), a halogenated molecule (e.g. dichlorobenzene, chloroform), or a mixture of one or more of these molecules. Because conjugated polymers have limited solubility, the samples must often be dissolved at a high temperature (e.g. >80° C. for P3HT in xylene or >120° C. for P3HT in dodecane). The total concentration of polymer in the solution is selected to be low (typically <1 wt %) to prevent the formation of an elastic gel when the temperature is lowered. For P3HT in xylene, the gel point is about 0.5 wt %.

Next, the temperature of the hot dissolved polymer solution is lowered to a value that induces self-assembly. For P3HT in xylene, this value is usually <60° C. The temperature that is used to induce polymer self-assembly will vary depending on the specific type of polymer and solvent that is being used. The temperature can be lowered rapidly and held fixed at a particular value or it can be lowered gradually using a temperature ramp. Depending on the temperature, solvent, polymer type and concentration that is used, the final structure of the self-assembled polymer can be manipulated.

Figure 5:
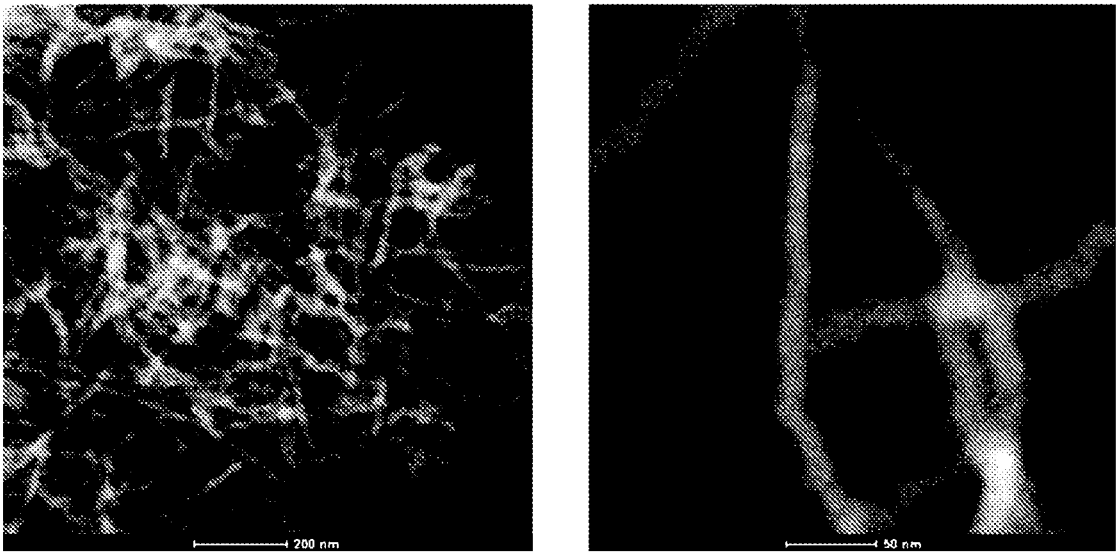
FIG. 5 illustrates TEM micrographs of nanostructured P3HT formed in xylene through self-assembly triggered by a temperature change from 80° C. to −20° C.

Next, the sample is allowed to undergo self-assembly for a total duration that can range from a few minutes to several days. The result is a stable and fluid colloidal dispersion of conjugated polymer nanofiber networks such as those shown in FIG. 5. The size and dimensions of the dispersed fibers and the networks is controllable by modifications to the polymer chemistry (monomer type), the molecular weight, the self-assembly temperature and the solvent.

In one embodiment, the colloidal dispersion is formed by self-assembly through the gradual change of solvent composition selected from the group consisting of alkanes, aromatics, and halogenated organic molecules.

Scheme 2: Colloidal Dispersions from Organogel Self-Assembly and Fragmentation

The first step is identical to the first step of Scheme 1 above, with the following exception. The total concentration of polymer in the solution is selected to be relatively high (typically >1 wt %) to form an elastic gel when the temperature is lowered and self-assembly occurs. For P3HT in xylene, the gel point is about 0.5 wt %.

Next, a step identical to the second step of Scheme 1 is performed, but a gel is formed instead of a fluid colloidal dispersion, due to the high polymer concentration in solution.

Next, the sample is allowed to undergo self-assembly for a total duration that can range from a few minutes to several days. The result is an elastic conjugated polymer nanofiber network or organogel.

The solvent that was used to form the gel network in the previous steps can be replaced (if desired) with a different solvent by adding the new solvent to the top of the sample and allowing for diffusion to occur. The new solvent is chosen to not dissolve the self-assembled polymer network. Several consecutive changes of this solvent "cap" can be used to fully replace the original solvent.

Finally, the gel sample is fractured mechanically. The method of gel fracture can be manual mixing, high-shear mixing or compounding, ultrasound fragmentation, extrusion or any other mechanical mechanism. The final particle size is determined by the method used to fragment the gels.

The fragmented gels result in a colloidal dispersion, similar to that of Scheme 1. The final concentration of the dispersion can be reduced by adding an adequate amount of solvent before the fragmentation process is initiated. The result is a stable colloidal dispersion of nanofiber networks.

Step 2: Chemical Doping of Network Dispersions

The nanostructures are chemically doped after inducing self-assembly and formation of fiber networks in Step 1.

Figure 1E:
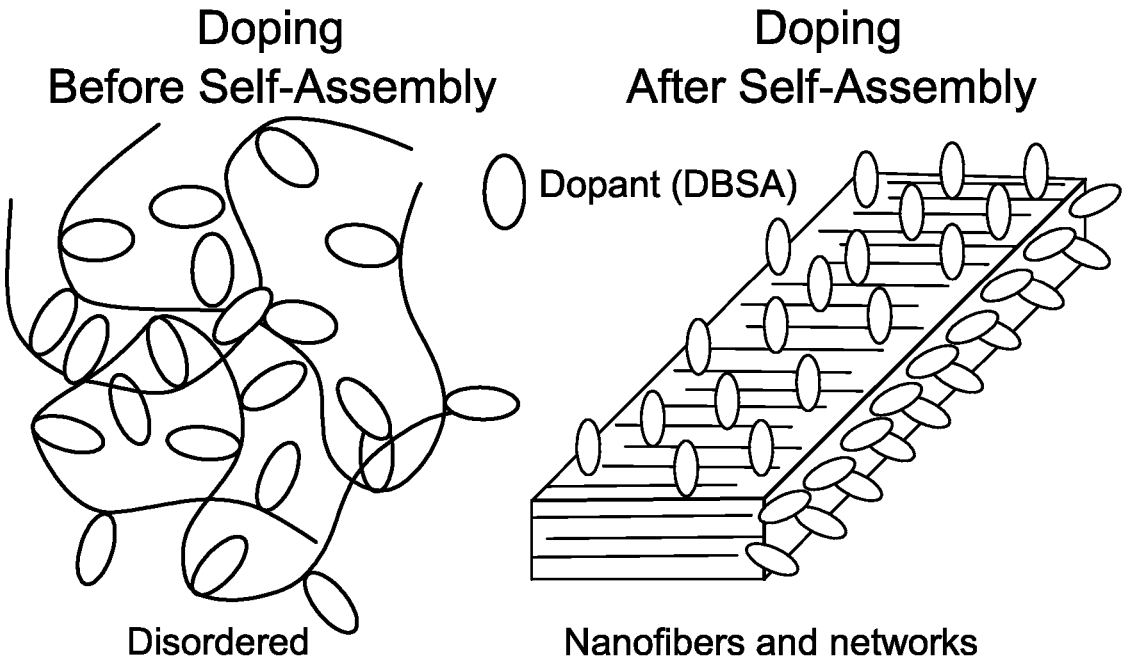
FIG. 1E schematically illustrates the effect of chemical doping of conjugated polymers on nanofiber networks formed before and after doping.

FIG. 1E illustrates the issues associated with chemical doping when it is performed before self-assembly. Because doping results in the formation of a strongly associated anion-cation pair, the new polymer structure is altered and self-assembly is prevented. The structure and conductivity of samples doped before self-assembly differs from that of samples that are doped after self-assembly, indicating the importance of maintaining structural control.

The following scheme is used to dope colloidal dispersions or gels prepared as described in Step 1.

Typical doping molecules for conjugated polymers (p-type) are small molecules (e.g. iodine), organic soluble sulfonic acids (e.g. dodecyl-benzene sulfonic acid or DBSA) or ionic polymers (e.g. partly sulfonated polystyrene). The doping molecules are added directly to the conjugated polymer colloidal dispersions at a specified molar ratio with respect to the total number of monomers present in the conjugated polymer sample. For this application, larger doping molecules (e.g. DBSA or sulfonated polystyrene) are typically used because smaller molecules (e.g. iodine) can slowly leach out from the self-assembled conjugated polymer structure and this can reduce the electrical conductivity over time. Colloidal stability is maintained after doping, but sonication or mechanical agitation can also be used to increase dispersion quality.

In one embodiment, the chemical dopant is selected from the group consisting of oxidizing agents including iodine, organic soluble sulfonic acids (e.g., dodecyl benzyl sulfonic acid), water-soluble sulfonic acids (e.g., p-toluene sulfonic acid), organic salts (e.g., iron III tosylate), and acidic polymers (e.g., polystyrene sulfonate in acid form).

Figure 6:
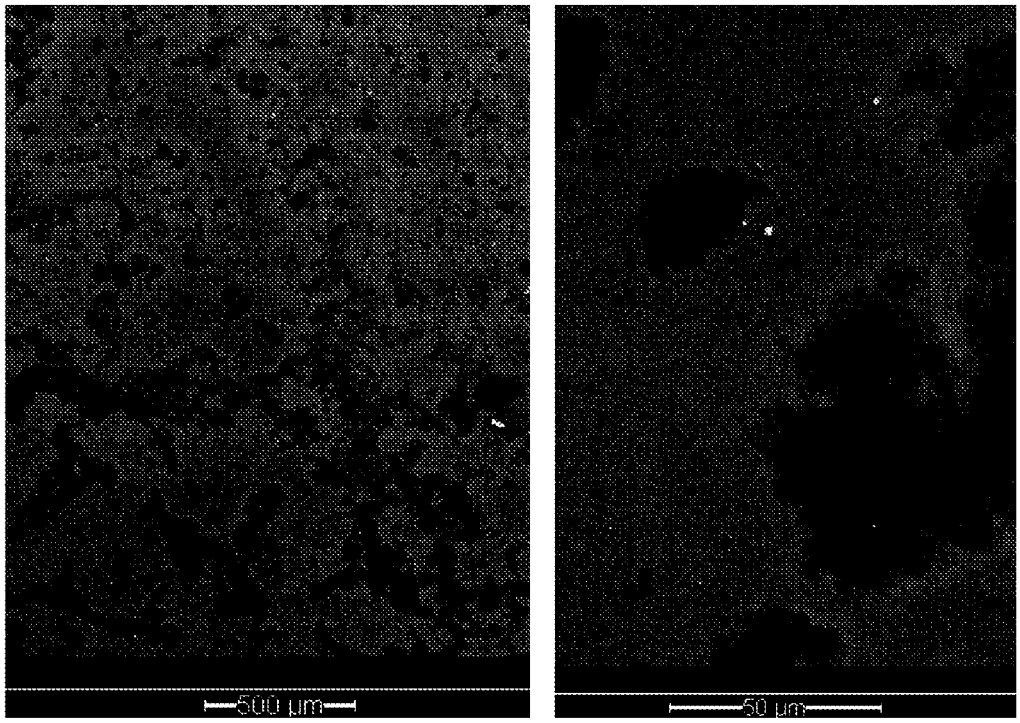
FIG. 6 illustrates SEM micrographs of deposited colloidal particles after doping conjugated polymer nanofiber networks contained therein with iodine.

FIG. 6 shows SEM images of deposited colloidal particles (produced using Step 1, Scheme 1) after doping with iodine in excess after inducing self-assembly in xylene at 20° C. The large colloidal particles are visible but the individual fibers are too small to resolve.

Figure 7:
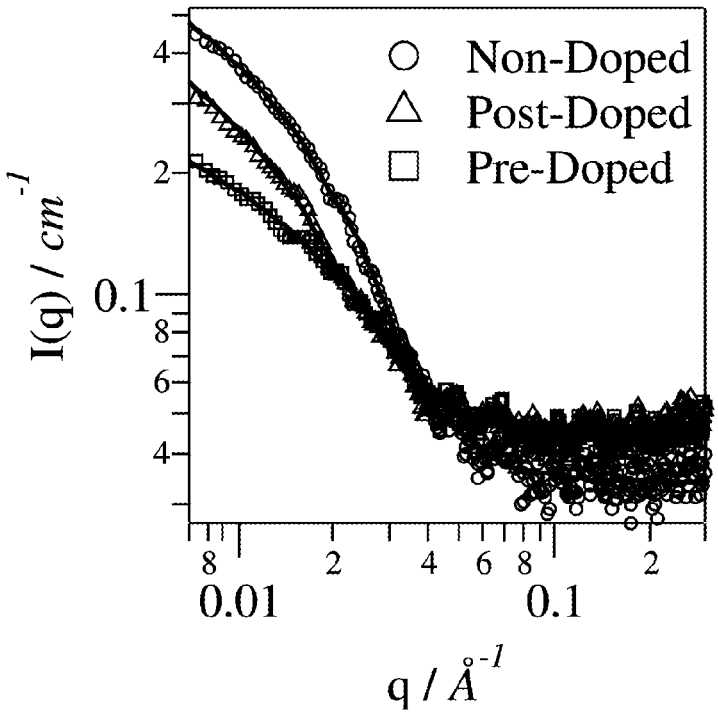
FIG. 7 graphically illustrates small angle x-ray scattering (SAXS) profiles of P3HT self-assembled in toluene at a concentration of 0.2 wt % and at a temperature of −20° C. after dissolution at 80° C.

FIG. 7 and Table 1 show the results of small angle X-ray scattering (SAXS) experiments demonstrating that the fiber structure is preserved when doping is performed after self-assembly, but it is significantly affected when it is performed before self-assembly. The samples of FIG. 7 are P3HT self-assembled in toluene at a concentration of 0.2 wt % and at a temperature of −20° C. after dissolution at 80° C. The SAXS model fit in Table 1 demonstrates that fiber structure (thickness) is preserved when nanostructures are doped with iodine after self-assembly. When doping is performed before self-assembly the fibers are thinner and narrower.

TABLE 1

Results of SAXS fits to rectangular fiber model for P3HT self-assembled in toluene with $I_2$ dopant added before and after assembly.

| | Non-Doped | Post-Assembly Doped | Pre-Assembly Doped |
|---|---|---|---|
| Fiber Height (nm) | 7.7 ± 0.2 | 7.8 ± 0.4 | 6.6 ± 0.5 |
| Fiber Width (nm) | 16.1 ± 0.6 | 21.0 ± 1.8 | 12.6 ± 0.9 |

Figure 8:
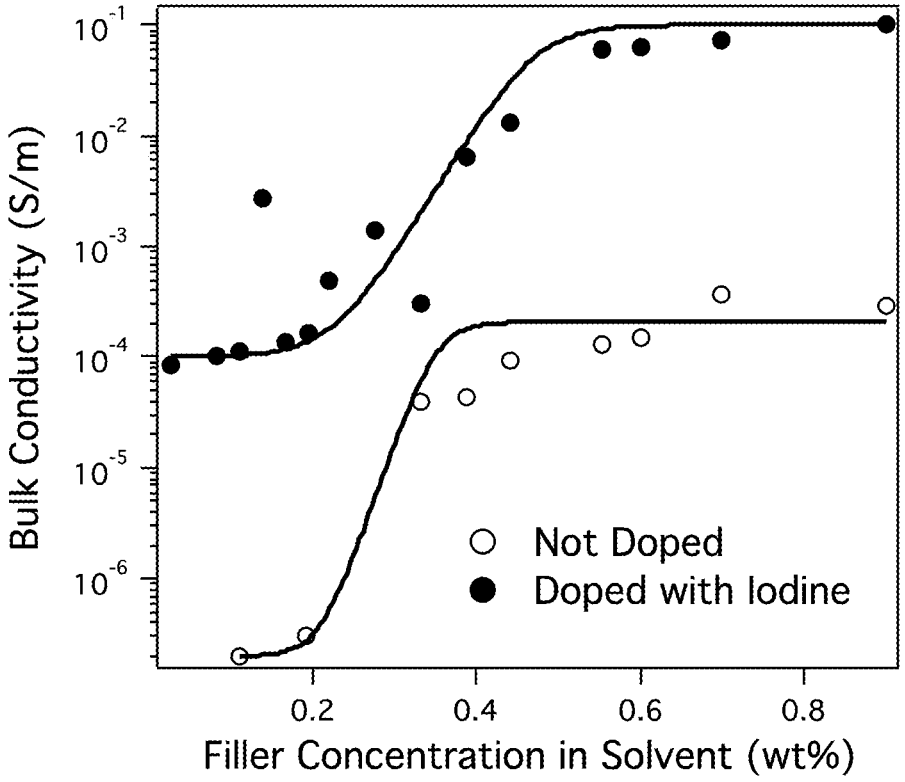
FIG. 8 graphically illustrates bulk conductivity of nanostructured P3HT colloidal networks, formed in xylene through a temperature change, as a function of concentration and doping (excess iodine). Percolation thresholds are in the range of 0.3 to 0.6 wt % filler.

The extent of doping can also be monitored and optimized by measuring the bulk conductivity of the dispersions (FIG. 8). FIG. 8 illustrates bulk conductivity of nanostructured P3HT colloidal networks, formed in xylene through a temperature change, as a function of concentration and doping (excess iodine). Percolation thresholds are in the range of 0.3 to 0.6 wt % filler. Chemical doping is associated with a sharp enhancement of conductivity, where increases by factors of 10-1,000 or more are typical.

Step 3: Dispersion of Doped Conjugated Polymer Nanostructures in Paints, Primer or Organic Resins.

Samples prepared via Steps 1 and 2 are dispersed into a polymerizable resin (e.g. epoxy BADGE) or an oil-based paint or primer formulation (e.g. polyurethane) by following these steps. Other possible matrix materials include polysiloxanes, acrylics, laquers, shellacs, alkyds, phenolic resins, dissolved polymers (e.g. polystyrene or polybutadiene) as well as polymerizable monomers such as styrene.

First, the doped conjugated polymer nanostructures are prepared by dispersing in a solvent that is miscible with the binder, paint or primer that will be modified (made conductive). This can be achieved by centrifugation, filtration or evaporation of the original solvent of the conjugated polymer nanostructure followed by the addition of the desired amount of miscible solvent.

To achieve total re-dispersion of the conductive network, it is optional to apply some external mechanical force via ultrasound or high-shear mixing.

The first steps can also be used to increase the concentration of the conductive filler (the conjugated polymer nanostructure) via re-dispersion in a smaller quantity of new solvent. Total removal of solvent should be avoided because it can cause the irreversible collapse of the colloidal network particles and a more compact structure will result in larger percolation thresholds and lower conductivity. Also, it is desirable to concentrate the colloidal networks as much as possible so that the addition of the additive does not cause the excessive dilution of the carrier paint or resin. Thus, samples should be concentrated as much as possible while maintaining colloidal stability and allowing for homogeneous dispersion in the carrier. This is the optimum formulation. Conditions will vary for different polymers, dopants and colloidal network structures.

In one embodiment, the step of dispersing the colloidal dispersion within the liquid matrix comprises dilution of the matrix and colloidal dispersion with a volatile organic solvent followed by concentration via solvent evaporation using heat or vacuum.

In one embodiment, the step of dispersing the colloidal dispersion within the liquid matrix comprises sonication or mechanical blending.

After the filler additive is available in a miscible solvent at the desired concentration, it is added to the carrier and mixed thoroughly to ensure homogeneous dispersion. If the addition of the filler causes unwanted dilution of the carrier, the original concentration can be obtained through the evaporation of the solvent.

Figure 9:
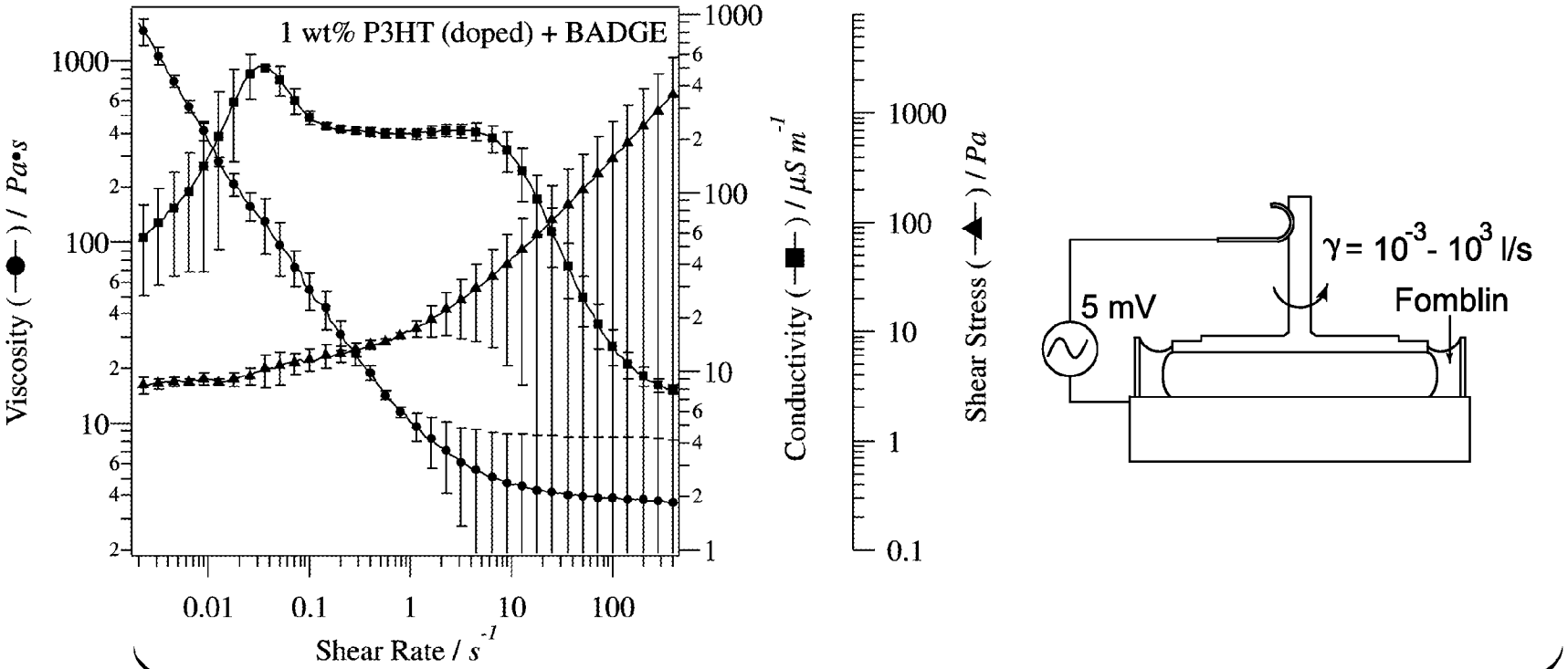
FIG. 9 graphically illustrates bulk conductivity of a P3HT dispersion doped with iodine (in excess) and dispersed in pure epoxy precursor (BADGE or bisphenol A diglycidyl ether) as a function of shear rate. Measurement is performed in a rheometer with 25 mm parallel plates. Conductivity improves or is maintained during shear flow up to shear rates of 10 $s^{-1}$. Also illustrated is a schematic and picture of the rheo-dielectric testing apparatus.

The dispersion of nanostructured conductive fillers in epoxy resins is demonstrated in FIG. 9, which illustrates bulk conductivity of P3HT dispersion doped with iodine (in excess) and dispersed in pure epoxy precursor (BADGE or bisphenol A diglycidyl ether) as a function of shear rate. Measurement is performed in a rheometer with 25 mm parallel plates. Conductivity improves or is maintained during shear flow up to shear rates of 10 $s^{-1}$.

The conductivity of the carrier BADGE by itself is only 0.01 S/m. When, 1 wt % of P3HT nanostructures doped with iodine are added, the conductivity increases to a rest value (zero-shear) of 56 S/m.

Furthermore, when shear is applied, the conductivity increases to a maximum value of 504 S/m, suggesting that the filler was further dispersed. At high shear rate values (>10 $s^{-1}$) a decrease in conductivity is observed suggesting that some fiber breakup may occur upon application of high shear.

Figure 10:
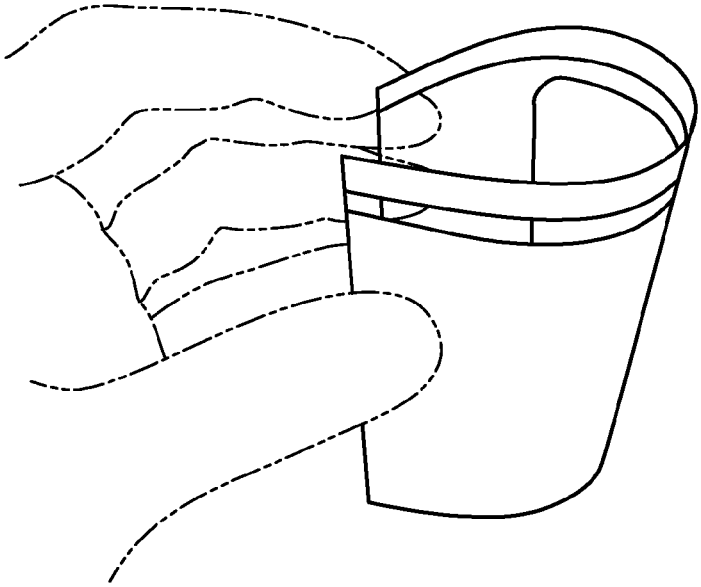
FIG. 10 illustrates images of a film of P3HT doped with iodine after self-assembly and dispersed at a concentration of 1.2 wt % in a commercial polyurethane formulation. The conductive film is flexible and retains the properties of pure polyurethane films because of the low filler loading fractions.

The same procedure was also followed to disperse doped P3HT nanostructures into a commercial polyurethane formulation (Parks Pro-Finisher Polyurethane for Floors Clear). This formulation was then coated using doctor blading to form a homogeneous wet film over a polyethylene terephthalate (PET) substrate with a thickness of 2 mils. The conductive paint was then allowed to dry and the surface resistivity of the conductive coating was measured using the Van der Pauw 4-point probe method. Surface resisitivity values of $1.4\times10^6$ Ohm/sq were measured for a conductive filler content of 1 wt % (based on wet sample). Optimization of the network particle size, the dopant additive, the dispersion state and the concentration of filler can further reduce the resisitivity. For reference, the surface resisitivity of PET substrates ranges from $10^{12}$-$10^{16}$ Ohm/sq depending on the relative humidity. Therefore, enhancement of the surface electrical conductivity has been demonstrated. Notably, the mechanical properties of the film (e.g. flexibility and adhesion) are similar to that of the original polyurethane carrier resin. FIG. 10 illustrates the flexibility of a representative sample applied to PET. The sample of FIG. 10 is measured with 4-point probe measurements according to the Van der Pauw method, for P3HT doped with iodine after self-assembly and dispersed at a concentration of 1.2 wt % in a commercial polyurethane formulation. The conductive films are flexible and retain the properties of pure polyurethane films because of the low filler loading fractions.

Effects of Doping on the Morphology of Conducting Polymer Nanostructures

Figure 11:
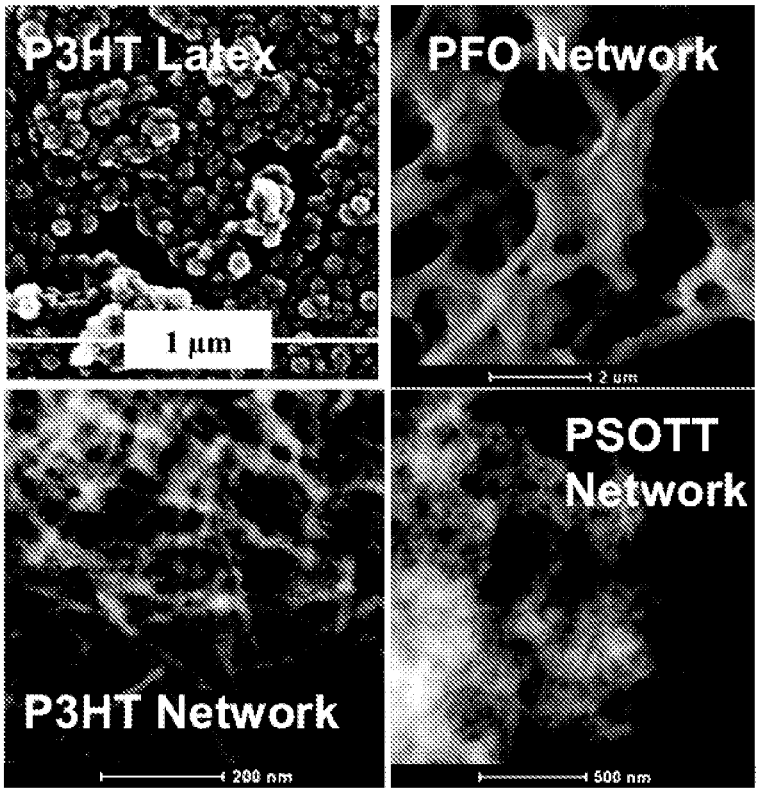
FIG. 11 illustrates SEM micrographs of common nanostructures formed from conjugated polymers.

We have designed model systems that will allow us to systematically analyze and understand the intimate relationship between structure and properties in conductive films prepared from CPs. We have used epoxy resins based on bisphenol A diglycidyl ether (BADGE) and commercial polyurethane formulations as a model matrix materials, but expect the results to also be relevant to other organic matrices used for vehicular finishes. For the CP systems we have primarily used model systems of alkyl substituted polythiophenes and polyfluorenes due to their rich morphological behavior. These polymers have molecular architectures that allow them to exist in various morphological states (e.g. coils, fibers, networks, aggregates and gels) by tuning the self-assembly and aggregation. FIG. 11 presents SEM micrographs of exemplary CP architectures, include P3HT in latex and nanofiber network form; PFO in nanofiber network form, and poly[(4,4'-bis(2-octyl)dithieno[3,2-b:2'3'-d]silole)-2,6-diyl-alt-(2,5-bis(3-octylthiophen-2yl)thiazolo[5,4-d]thiazole)] (PSOTT) in nanofiber network form. These results can be applied to the large diversity of CPs that have been synthesized within the last two decades.

Because our interest is in conductive films, the materials are doped with oxidizing molecules. In this example, we explore two different dopants, iodine and dodecylbenzenesulfonic acid (DBSA). After the oxidation reaction, dopant molecules usually remain associated to the doped CP forming a macromolecular salt. These two molecules allow us to evaluate the effect of dopant size on the self-assembly and morphology of the CP nanostructures and on the properties of the resulting conductive coatings. We also use PEDOT:PSS dispersions as a benchmark CP material to compare to our coatings. PEDOT:PSS is one of the most effective CP conductors. However, because it requires coating in its pure form, PEDOT:PSS films do not meet rigorous mechanical, environmental and adhesion specifications of vehicular finishes.

Doping of conjugated polymers has been demonstrated to lead to large increases in electronic conductivity. Charge conduction, whether occurring in a doped or un-doped state, requires percolation and is thus intimately tied to the morphology and nanostructure. CPs are ideal materials for charge conduction because they self-assemble into a variety of nanostructures, including nanofibers and networks, when they are dissolved in solvents of intermediate quality. This is driven by 1D crystallization due to π-π stacking interactions.

Doping of CPs is not common. Particularly, most CPs (e.g., P3HT) are targeted for use as semiconducting compounds and doping or oxidation of the compounds is actively avoided. In the disclosed embodiments, however, the CPs are intentionally doped in order to improve conductivity. Undoped CPs integrated into composites as disclosed herein would not provide sufficient EME management materials to solve the problems addressed by the disclosed embodiments.

Doping usually involves the oxidation of CPs leading to the injection of positive charge carriers (i.e. holes) that increase conductivity. The small molecule iodine is frequently used to dope CP films. Doping is also possible with larger acids that are soluble in organic solvents (e.g. DBSA).

One important effect of doping is that the dopant usually remains tightly associated to the polymer and forms an ionic complex that is analogous to a macromolecular salt. Because the dopant remains associated to the polymer, it can obstruct the self-assembly of the CP because it can interfere with π-π stacking interactions. For example, when doping occurs prior to self-assembly (i.e. chains are doped in a dissolved state), bulky dopants (e.g. DBSA) could prevent growth of nanofibers and networks by intercalating between chains and instead lead to disordered aggregation of the CP (FIG. 1E).

These disordered structures lead to lower conductivities. To prevent this, nanofibers are grown via self-assembly in a desired solvent and temperature in the un-doped state. Doping is then performed after self-assembly so that the dopants only decorate the outside of the nanostructures and do not alter the internal morphology. Furthermore, it may also be possible to substantially increase conductivity with smaller dopants (e.g. iodine) or by using lower amounts to avoid affecting the nano-scale morphology. Doping of CPs after the induction of self-assembly allows retention of the original nanostructure and lead to highly conductive materials.

The morphological effects of doping in systems of polythiophene CPs dispersed in aromatic solvents and in BADGE resins were studied. Doping is induced in the aromatic solvents prior-to or after self-assembly of nanofibers and networks by adding variable amounts of DBSA or iodine. Adjusting the level of supersaturation, via changes to temperature or solvent quality, allows effective control of the morphology of nanofibers and branched networks.

Percolation Behavior of CP Nanostructures

Composite materials incorporating conductive fillers typically show behavior that is distinctive of percolating systems. Random percolation theory, originally introduced in 1957 to describe the flow of fluids through a porous medium, applies statistical analyses and models to describe non-linear changes in macroscopic properties that occur when dispersed materials "percolate" or interconnect through a medium. Conductive nanocomposites, especially those containing additives with high aspect ratio, undergo steep non-linear increases in conductivity with increasing concentration. In this example, we use existing models based on random percolation theory to describe the concentration dependence of the electrical properties of composite materials incorporating CP additives with variable nanostructures (e.g. coils, nanofibers, networks or particles) as shown in FIG. 11. Percolation theory and other models could be especially useful to rationally design nanostructures that maximize electrical conductivity and minimize the required amount of additives and associated costs. These models can also be valuable tools for the formulation of coatings incorporating other types of conductive additives. The current processes that are used to formulate conductive coatings significantly benefit from the fundamental understanding of the governing physical principles.

The conductivity of a material above its percolation threshold ($\phi_{crit}$) can frequently be described with a simple power-law equation: $\sigma=\sigma_o(\phi-\phi_{crit})^t$ where σ is the conductivity of the composite, $\sigma_o$, is the conductivity of the pure filler material, φ is the volume fraction of filler and t is the critical exponent. In the context of designing conductive finishes, it is desired to minimize the value of $\phi_{crit}$ and to maximize the value of t so that smaller amounts of additives are required to achieve the desired properties. Extensive Monte Carlo simulations in two and three dimensions have been performed to theoretically estimate values for $\phi_{crit}$ and t for model systems having various shapes and states of orientation. Spheres typically have high percolation thresholds (e.g. 37 vol % for silver particles in Bakelite) and low critical exponents (1.3-2) suggesting that they are not effective shapes for additives. However, the percolation threshold is also affected by particle size and generally increases with larger particle radius. In contrast, randomly oriented conductive fibers have much lower percolation thresholds (e.g. 4.5 vol % for carbon fibers) and higher critical exponents (t>3) due to their elongated shape. This shape leads to large probabilities of fiber overlaps that help to create a conductive path. For fibers, $\phi_{crit}$ is again dependent on the fiber radius explaining why carbon nanotubes are such effective conductive additives. In general, nanostructures with high aspect ratios and high surface-to-volume ratios (i.e. small size) result in improved conductivity when randomly packed. However, fiber orientation effects, like those due to shear, can also increase the percolation threshold, lower the critical exponent and generally decrease conductivity.

Nanofiber networks are superior CP nanostructures in conductive coatings because they are formed from elongated fiber subunits that lower percolation thresholds. In addition, they will also be less likely to undergo shear orientation due to their isotropic structures.

Percolation thresholds and critical exponents in networked nanomaterials have not been studied in as much detail as spherical particles and fiber systems because there are fewer conductive additives available that have controllable network structures. Networks of CPs are spontaneously formed when nanofibers branch during the crystallization process due to lattice mismatch defects. The occurrence of defects, and thus the branching frequency, can be manipulated by altering the supersaturation conditions of the polymer. It has been demonstrated that the network morphology can be modified to range from highly branched to loosely branched (even single fibers) by allowing self-assembly to proceed in different solvents or at different temperatures. The branching density can also be quantified by describing CP networks as fractal structures where the number of fibers (N) located in a sphere of radius (r) is described by, $N \sim r^D$. The parameter D is commonly known as the fractal dimension and, for three-dimensional systems, its value ranges from 1 (for un-branched fibers) to ~3 (very dense solid-like networks). The value of D is experimentally accessible has been measured in our laboratory for P3HT nanofiber networks (un-doped) with small angle neutron scattering (SANS). The average network size is also quantified via electron microscopy (e.g. TEM, SEM). Impedance spectroscopy is used to measure the conductivity of samples having different nanostructures, doping levels and concentrations.

Figure 12:
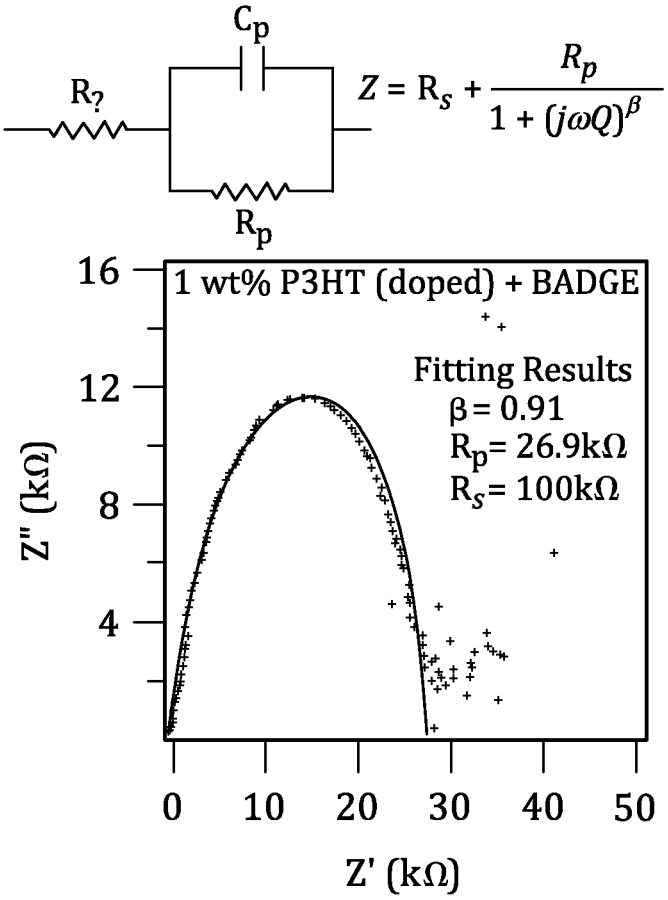
FIG. 12 is a circuit model and Nyquist plot of the impedance of a doped P3HT network in uncured epoxy.

FIG. 12 shows a representative Nyquist plot for a 1 wt % P3HT nanofiber network dispersion in BADGE epoxy resin that was doped with iodine after inducing self-assembly. The impedance spectrum was modeled with a constant phase element (CPE) model corresponding to the equivalent circuit shown in FIG. 12. Impedance analysis allows isolation of all the resistances and capacitances that could affect the measurements in order to ensure that accurate values of the bulk material conductivity and resistivity are obtained.

Flow-Induced Structural Transitions in Conductive Polymer Coatings

During common coating processes, materials are frequently subjected to high shear rates that can significantly affect the electronic properties of the final finish. In the case of spray coating, which is the most common approach to apply aircraft finishes, the effective shear rate of the fluid being coated can range from 100 to 10,000 $s^{-1}$. Such high shear fields could result in significant alterations to the morphology and therefore also affect the properties of the final coating. There are two primary mechanisms that could lead to deterioration of electrical conductivity due to flow effects: 1) flow-induced alignment of conductive fillers and 2) shear induced morphological changes of the additives (e.g. network fracture). In this example we discuss the fundamental principles leading to shear-induced transitions in our systems.

Nanofiber networks of CPs will not undergo significant shear-alignment but can and will be fractured when local stress fields exceed a critical value ($\tau_c$). In contrast, nanofiber dispersions (i.e. un-branched individual fibers) undergo significant shear-alignment that will lead to deterioration of the electronic properties in the coatings.

Combined structure-property experiments can be used to systematically study the effects of shear on the same systems that we have described in the previous sections. We use a specially configured shear cell that interfaces with a commercial rheometer (Anton Paar MCR 301) to simultaneously perform rheological and impedance spectroscopy analysis (i.e. rheodielectric tests) of CP nanostructures that are dispersed in epoxy resins (BADGE). FIG. 9 shows a schematic and a picture of the setup along with an example of preliminary rheo-dielectric data for P3HT nanofiber networks.

This sample was doped with iodine after self-assembly and dispersed in un-cured BADGE epoxy (1 wt % P3HT). For reference, the conductivity of the neat BADGE resin is just 0.01 μS/m and the value does not change with shear rate. In this experiment, the addition of just 1 wt % of the P3HT nanostructured networks resulted in an increase of more than 50,000 times the conductivity of the epoxy. Notably, this is preliminary data and the samples have not been optimized for doping levels, concentration or morphological parameters. Thus, even larger improvements in conductivity could be expected from optimization.

More importantly, there is a complex dependence of the electrical conductivity with the applied shear-rate for this sample. At low shear rates (<0.04 $s^{-1}$) there is a steady increase in conductivity that could result from the reorganization of the filler material increasing the probability of network contacts and improving percolation. At intermediate shear rates (0.1-10 $s^{-1}$) there is a region of constant conductivity.

Finally, at high shear-rates (>10 $s^{-1}$) there is a steady decrease in conductivity as a function of shear that could indicate the onset of network breakup or orientation effects. The corresponding shear stress where the sharp decrease in conductivity occurs could be related to the critical shear stress ($\tau_c$) for network fracture. The conductivity in this sample decreases by ~60 times from its maximum value indicating that shear effects are significant.

While illustrative embodiments have been illustrated and described, it will be appreciated that various changes can be made therein without departing from the spirit and scope of the invention.

The embodiments of the invention in which an exclusive property or privilege is claimed are defined as follows:

1. A method of forming a composite incorporating networks of conductive polymer nanofibers, the method comprising the steps of:

(a) providing a colloidal dispersion comprising a self-assembled network of nanofibers comprising a conjugated polymer;

(b) doping the conjugated polymer with a chemical dopant to provide conductive polymers within the self-assembled network of the colloidal dispersion; and (c) dispersing the colloidal dispersion within a liquid matrix to provide a liquid composite comprising a network of conductive polymer nanofibers, wherein the liquid matrix is selected from the group consisting of a polymer and a polymer precursor.

2. The method of claim 1 further comprising a step of solidifying the liquid composite to provide a solid composite comprising the network of conductive polymer nanofibers in a solid polymer matrix.

3. The method of claim 1, wherein the colloidal dispersion is formed by temperature-induced self-assembly of the conjugated polymer in a solution.

4. The method of claim 1, wherein the colloidal dispersion is a fluid colloidal dispersion.

5. The method of claim 1, wherein the colloidal dispersion is prepared from the mechanical fracture of a gel.

6. The method of claim 5, wherein the gel is an elastic organogel comprising the self-assembled network of the conjugated polymer.

7. The method of claim 1, wherein the colloidal dispersion is formed by self-assembly through the gradual change of solvent composition selected from the group consisting of alkanes, aromatics, and halogenated organic molecules.

8. The method of claim 1, wherein the conjugated polymer is a semiconducting polymer.

9. The method of claim 1, wherein the conjugated polymer is selected from the group consisting of a polyalkylthiophene, a polydi-alkyl fluorene, a polydithienosilole, a polyphenylene, a poly(3,4-ethylenedioxythiophene), a poly (pyrrole), a polypyrene, a polypyridine, a poly(p-phenylene vinylene), a polycarbazole, a polyaniline, a polyindole or a copolymer of the polymers listed within this group.

10. The method of claim 1, wherein the chemical dopant is selected from the group consisting of oxidizing agents including iodine, organic soluble sulfonic acids, water-soluble sulfonic acids, organic salts, and acidic polymers.

11. The method of claim 1, wherein the liquid matrix is selected from the group consisting of a polymerizable resin, an oil-based paint, and an oil-based primer.

12. The method of claim 1, wherein the step of dispersing the colloidal dispersion within the liquid matrix comprises dilution of the matrix and colloidal dispersion with a volatile organic solvent followed by concentration via solvent evaporation using heat or vacuum.

13. The method of claim 1, wherein the step of dispersing the colloidal dispersion within the liquid matrix comprises sonication or mechanical blending.

14. The method of claim 1, wherein the network of conductive polymers nanofibers comprises fibers having an individual length of from 50 nm to 5 microns.

15. The method of claim 1, wherein the network of conductive polymers nanofibers comprises fibers having a cross-sectional dimension of from 5 nm to 200 nm.

16. The method of claim 1, wherein the network of conductive polymers nanofibers comprises fibers having a plurality of branch points spaced between 200 nm to 5 microns apart.

17. The method of claim 1, wherein the colloidal dispersion is from 1 micron to 1 mm in size.

* * * * *